US008776268B2

(12) United States Patent
Rodgers et al.

(10) Patent No.: US 8,776,268 B2
(45) Date of Patent: Jul. 15, 2014

(54) HAND COVERING(S) WITH DISPENSER AND/OR RECEPTACLE POCKET

(75) Inventors: Ellen Rodgers, Brunswick, ME (US); Paul F. Mirto, Brunswick, ME (US)

(73) Assignee: Harpswell Harmony LLC, Brunswick, ME (US)

( * ) Notice: Subject to any disclaimer, the term of this patent is extended or adjusted under 35 U.S.C. 154(b) by 657 days.

(21) Appl. No.: 12/959,584

(22) Filed: Dec. 3, 2010

(65) Prior Publication Data

US 2011/0131702 A1 Jun. 9, 2011

Related U.S. Application Data

(60) Provisional application No. 61/266,772, filed on Dec. 4, 2009.

(51) Int. Cl.
*A41D 19/00* (2006.01)

(52) U.S. Cl.
USPC ..... 2/160; 2/158

(58) Field of Classification Search
USPC ..... 2/158, 160, 159, 161
See application file for complete search history.

(56) References Cited

U.S. PATENT DOCUMENTS

| | | | | |
|---|---|---|---|---|
| 4,330,120 | A * | 5/1982 | Netti | 482/105 |
| 4,536,889 | A | 8/1985 | Taylor | |
| 4,805,242 | A * | 2/1989 | Bolton | 2/160 |
| 5,577,273 | A * | 11/1996 | Newkirk et al. | 2/160 |
| 5,864,883 | A | 2/1999 | Reo | |
| 7,232,040 | B2 | 6/2007 | Decker et al. | |
| 7,251,837 | B1 | 8/2007 | Horton | |
| 7,275,658 | B2 | 10/2007 | Decker et al. | |
| 2004/0172736 | A1 * | 9/2004 | Reid | 2/169 |
| 2007/0101479 | A1 | 5/2007 | Turner | |
| 2007/0119891 | A1 | 5/2007 | Lawrence | |
| 2011/0072552 | A1 * | 3/2011 | Johnson et al. | 2/160 |
| 2011/0088138 | A1 * | 4/2011 | Chen | 2/160 |

FOREIGN PATENT DOCUMENTS

| | | | |
|---|---|---|---|
| GB | 1167661 | A | 10/1969 |
| GB | 2455577 | A | 6/2009 |
| JP | 2005/076170 | A | 3/2005 |
| JP | 2009/007735 | A | 1/2009 |

OTHER PUBLICATIONS

Colleen Meagher "Subway Mittens", Item # EPO287, Interweave, Published Winter 2007, (2 pages).

* cited by examiner

*Primary Examiner* — Khoa Huynh
*Assistant Examiner* — Andrew W Collins
(74) *Attorney, Agent, or Firm* — Smith, Gambrell & Russell, LLP.

(57) ABSTRACT

A hand covering comprising a main body having a reception cavity dimensioned for receipt of a hand of a user, a pocket covering that defines a reception region and is secured to said main body along a peripheral edge perimeter of the pocket covering. The pocket covering having a first panel with a free edge and a second panel with a free edge; and the free edges being arranged as to provide an access opening that is positioned inward relative to the edge perimeter and which access opening defines a sheet material insertion or removal location relative to the reception region.

22 Claims, 16 Drawing Sheets

FIG. 1 Left Thermal Hand Warmer

FIG. 2 Thermal Hand Warmer (left hand)

FIG. 3 Thermal Hand Warmer (left hand)

FIG. 4 Thermal Hand Warmer (right hand)

*"Right side" is side designated as outer-facing side for finished garment. "Wrong side" is inward facing side.

HAND COVERING(S) WITH DISPENSER AND/OR RECEPTACLE POCKET

CROSS REFERENCE TO RELATED APPLICATION(S)

The present application claims the benefit of U.S. Provisional Application No. 61/266,772, filed Dec. 4, 2009, which application is incorporated by reference.

FIELD OF THE INVENTION EXAMPLES

Embodiments of the invention include one or a pair set of hand coverings comprising a readily accessible, enclosed cavity or pocket providing a dispenser and/or receptacle. An embodiment includes a tissue dispenser and/or receptacle pocket such as one provided on the upper hand portion of a mitten or glove, or pockets provided in respective left and right members of a mitten or glove set.

SUMMARY OF THE INVENTION

An embodiment includes a hand covering that comprises a main body having a reception opening and cavity dimensioned for receipt of a hand of a user and a pocket covering that defines a reception region that provides a dispenser and/or receptacle pocket. The pocket covering is secured to the main body along a peripheral edge perimeter of the pocket covering, and the pocket covering has a first panel with a free edge and a second panel with a free edge. Also, the free edges are oriented as to provide an access opening that is positioned inward relative to the edge perimeter and which access opening defines a sheet material insertion or removal location relative to the reception region.

An embodiment of the hand covering features panels that are in an overlapping relationship such that the free edge of the first panel is exposed and the free edge of the second panel is covered over by the first panel. In addition, an embodiment includes an arrangement wherein the free edge of the first panel is positioned in an intermediate region of the pocket covering that falls in-between opposite pocket perimeter edge sections of the peripheral edge perimeter such as the perimeter edge section extending just inward of a thumb region of the hand covering, when a thumb region is present, and an opposing perimeter edge section on the opposite side of the pocket covering.

An embodiment has opposite pocket perimeter edge sections extending in an essentially common direction and in a finger extension direction, and the free edges of said first and second panels extend as well in the finger extension direction. An embodiment features having the opposite pocket perimeter edge sections and the free edges all extending essentially parallel.

An embodiment further features an arrangement wherein the overlap between the first and second panels is 30% or less than an overall exposed area of the pocket covering, as in an arrangement wherein the overlap is 5 to 25% as in 10 to 20%. An embodiment features a centrally positioned overlap region through which a dispenser package is received during insertion into the reception pocket. The dispenser package, once received in operating position, extends under a non-overlapped panel region of each of the first and second panels and thus extends to opposite sides of the overlapped region and also preferably to opposite sides of the access opening.

An embodiment also includes a hand covering in the form of a hand warmer as in a mitten or glove with a thumb extension and wherein the first panel includes an inner edge defining the free edge of the first panel and a perimeter edge section positioned opposite to the inner edge. The perimeter edge section of the first panel is secured to the main body. The second panel includes an inward edge defining the free edge of the second panel and a peripheral edge section positioned opposite to that inward edge, which is also secured to the main body. Under this arrangement, with the panels in an overlapping relationship, the free edge of the first panel is exposed and the free edge of the second panel is covered over by the first panel, and the free edge of the first panel is positioned closer to the thumb extension than the perimeter edge of that first panel.

An embodiment has the main body and the first and second panels all formed of a suitable hand covering material as in natural or synthetic source material. For example, a suitable source material is a hand covering fabric that is flexible and preferably also has some degree of expansion and contraction as is provided by a knit yarn material. The material can be common throughout (e.g., common color and/or quality) or a common material but of different colors in different sections (e.g., different panel(s)-to-body color schemes) or of different materials as in different source material between the panels and the main body as in a knit main body and a fleece pocket covering assembly.

An embodiment further features each panel of the pocket covering being essentially of a common or same area and preferably of a common configuration (e.g., each being a four sided panel with common length and width). In addition, an embodiment features the main body as including an extension portion (e.g., integrated extension of the same material of the main body or an added "patch" of material as in a plastic mesh layer or a stacked arrangement as with the base material of the main body extending under the pocket covering together with another base layer in a stacked arrangement that extends under the pocket covering as to further define the reception region) with the reception region being dimensioned for receipt of a sheet material dispenser package in a tight fit relationship both relative to a direction perpendicular to a plane lying flush on the extension portion of said main body and peripherally. For example, an embodiment features an expandable and contractible material as in an elastic material (e.g., added elastic cords) or a knit mesh which material tends to contract back following expansion (e.g., following content insertion) as to place the content of the reception region, such as a sheet material dispenser, in a state of compression. Also the covering pocket is designed to encompass and generally seal off the content of the reception region as in conjunction with a base extension section defined by the main body with the reception region being fully covered and entirely closed by the panels of the pocket covering until separation of the upper panel overlapping region relative to the underlying overlapped region.

An embodiment also has the reception region dimensioned such that a received dispenser package is generally centered relative to the overlapping end regions of the first and second panels (e.g., the dispenser, when in operating position and with its outer periphery confined by the peripheral edge of the pocket covering, generally extends an equal amount out to each side from the overlapping end regions).

An embodiment further features a pocket covering that is designed such that access to the reception region or pocket cavity is achieved by way of stretching of the first panel relative to the second panel and/or perimeter edging of the pocket covering and free of any pivoting of either of said panels relative to said main body as well as free of any fastener or the like (e.g., free of a button or other fastener).

In addition, a hand covering is provided wherein the pocket covering is arranged as to require a sheet of material such as a tissue that is contained in a dispenser received in the reception region to first travel in a first direction perpendicular to the free edge of the first panel and then travel in a second direction opposite to the first direction during exiting from the reception region and the pocket covering.

An embodiment includes a method of assembling a hand covering that comprises providing a main body having a reception cavity dimensioned for receipt of a hand of a user; and providing a pocket covering which defines a reception region. The pocket covering has a first panel with a free edge and a second panel with a free edge at least partially covered over by the first panel. Also, the free edges of the panels are oriented as to provide, when in use, a sheet material insertion or removal opening relative to the reception region. Further, the reception region extends to opposite sides of the free edge of the second panel in a common direction with tissue insertion or removal, and for an amount that is equal to or more than a length of overlap of the panels in the common direction.

An embodiment features a hand covering wherein the reception region is dimensioned for receipt of a sheet material dispenser package having 25 sheets or less with the sheets being in an interweaved relationship and being 0.5 mm to 3.0 mm in thickness. Also, an embodiment has the reception region dimensioned for receipt of a tissue dispenser package such as with the received dispenser package that is covered by the pocket covering and with the overlapping regions of the panels providing a tissue dispense opening in the hand covering as well as a sealing off cover function in the overlapped end regions.

An embodiment also has the pocket covering with an elongated configuration that has a longer extension in a direction of finger extension, and wherein the pocket covering extends to opposite sides of a knuckle covering region of the hand warmer in the direction of finger extension.

An embodiment of the invention further includes a hand covering kit, comprising a first hand covering and a second hand covering with each of the hand coverings having (a) a main body having a reception cavity dimensioned for receipt of a hand of a user; and (b) a pocket covering which defines a reception region. The pocket covering having a first panel with a free edge and a second panel with a free edge, with the free edges being oriented as to provide, when in use, a sheet material insertion or removal opening for accessing the reception region, and wherein the panels are in an overlapping relationship such that the free edge of the first panel is exposed and the free edge of the second panel is covered over by the first panel, and wherein the overlapping arrangement of the free edges is arranged such that sheet material access or removal is carried out by tensioning of the exposed free edge of the first panel as to convert the free edge of the first panel from a state of contact with the second panel to a state of at least partial separation from a previously contacted and overlapped region of the second panel.

An embodiment of the hand covering is arranged such that, when in use, the non-covered portions of the second panels of the first and second hand coverings are more closely positioned to each other than the covered portions of the second panels (as relative to the situation where a user extends arms straight out with knuckles up).

An embodiment features a hand covering that includes a main body with a cuff region for receipt of a hand of the user and a pocket covering that defines a reception region or pocket cavity. The hand covering further comprises a first panel with peripheral edging secured to the main body and a second panel with peripheral edging secured to the main body, and the first panel has a free edge region with a free edge and the second panel having a free edge region with a free edge, and the free edge region of the first panel extending over the free edge region of the second panel in an overlapping relationship as to have the free edge of the first panel define an access opening relative to the reception region and which access opening is in an intermediate region of the pocket covering.

An embodiment features a method of assembling a hand covering that comprises providing a main body having a reception cavity dimensioned for receipt of a hand of a user. The method further includes providing a pocket covering which defines a reception region, the pocket covering having a first panel with a free edge and a second panel with a free edge at least partially covered over by said first panel, and wherein the free edges are oriented as to provide, when in use, a sheet material insertion or removal opening relative to the reception region, and wherein the reception region extends to opposite sides of the free edge of the second panel in a common direction with tissue insertion or removal, and for an amount that is equal to or more than a length of overlap in the common direction.

DETAILED DESCRIPTION OF THOSE EMBODIMENTS SHOWN

Figure 1:
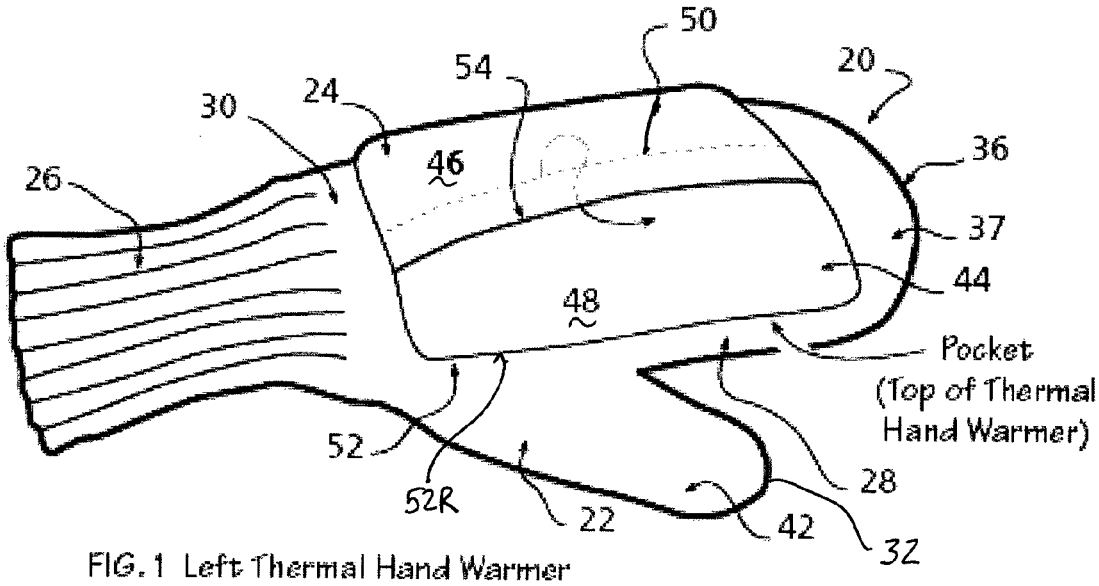
FIG. 1 shows a perspective view of a hand covering embodiment in the form of a thermal hand warmer such as a mitten (left mitten in this embodiment illustrated).

FIG. 1 shows a perspective view of hand covering 20 in the form of a mitten (left hand mitten) with main body 22 and integrated pocket 24. For the mitten embodiment shown, there is featured wrist covering portion 26 (in this embodiment, wrist covering 26 is a ribbed, encircling portion with or without added elastic means as in one or more elastic cords or ribbons extending fully around or partially around the wrist). The wrist covering has an opening at its free end for hand insertion.

Embodiments of the invention include alternate hand covering means in addition to the mitten illustrated embodiment, as in a mitten free of a thumb extension as well as gloves with or without fingers, etc. The illustrated mitten base body provides a base or foundation that is well suited for a pocket 24 embodiment of the present invention (e.g., one well suited for containment of a tissue or wipes packet such as those packets currently on the market for small volume usage as in 25 sheets or less with a tissue pack of 15 tissues being illustrative). Alternate embodiments do, however, include the aforementioned alternate hand coverings such as a glove or half-gloves (with exposed finger ends) having an integrated pocket. A variety of pocket shapes can be utilized as in those designed to conform to the desired object to be received. For example pocket 24 is shown with a polygonal shape but other pocket shapes include circular in addition to the distinct multi-sided configuration shown. Pocket 24 defines a reception region for a sheet material dispenser as in one with a matching shape or non-matching shape. As an example of a multi-sided shape, FIG. 1 illustrates a rectangular integrated pocket extending in the "longitudinal" direction of finger length. Alternately positioned integrated pockets include elongated pockets that extend perpendicular to a finger length direction, as in a pocket that is elongated in the lateral direction and positioned, longitudinally, between the wrist covering and the initiation of a finger digit cover region in the main body.

Also, embodiments include a hand covering all of a common material (e.g., 100% knit mittens) as well as other embodiments which include the addition of integrated pockets to a preexisting hand warmer base. Having, however, a fully integrated embodiment between the hand warmer main body as provided by a fully knitted main body and integrated pocket (e.g., one all of a common yarn material) provides a secure relationship that is well suited to handle the harsh usage environment of a hand warmer (e.g., repeated insertion into and out of tight pockets, etc.).

Also, an embodiment features common material throughout (same structural make up and quality with color the same or different). In embodiments not all of the same material there is used different material which materials are suited to provide a hand covering such as a thermal hand wanner type hand covering.

Suitable hand covering material include man-made and/or natural source material with examples of natural materials being plant based source materials as in cotton and hemp, and animal source materials as in fur, hair (e.g., the hair of sheep (wool) and certain other animals, including cashmere from goats, mohair from goats, vicuña, alpaca, and camel from animals in the camel family, and angora from rabbits, etc.), skins (e.g., leather). Examples of man-made source materials include synthetic materials as in synthetic fibers including woven, non-woven (e.g., fleece), knitted as well other techniques for integrating the source material (e.g., crocheting, sewing inclusive etc., with such integration techniques being suitable for both natural and man-made techniques where applicable).

A single source material can be used entirely or combinations of the source materials can be used whether of a same or different integration technique as in a main body formed of a leather or suede material and a woven, a knitted (knitted yarn), or a non-woven pocket covering of, for example, a non-woven production method product such as that used to form a fleece non-woven etc. In addition, the same or different source material can be provided in multiple layers as in a fur lining on a fleece main body or a multi-layered pocket covering such as one with a base other than that of the main body of the same or different material forming the outer panels of the pocket covering.

Examples of some suitable man-made source fabrics or materials for use in the main body and/or pocket covering elements include the following:

GORE-TEX® fabric of W. L. Gore & Associates, Inc; ARTIC FLEECE® material of Murray Goldenberg Textiles, Inc (described as a lightweight polyester fleece) and CHINELLA® fleece of MENRA MILLS CORP (described as a collection of three types of polyester fleece fabrics) INNOVA® MicroFleece material available from Hanesbrands Inc (described as a mid-weight thermal fabric knitted with Innova® polyolefin fibers together with a 10% Lycra® content that allows a 4-way stretch and contraction factor which provides a well suited stretch and return feature for the pocket coverings in an embodiment of the invention as described below); NANO-TEX® All Conditions Fleece material of NANO-TEX, LLC; OUTERBOUNDS™ of Tullahoma Industries (described as a double-sided fleece fabric made of 100% Innova®, a modified polypropylene yarn system produced by American Fibers & Yarns Company); POLARTEC® THERMAL PRO® material of MMI-IPCO, LLC LIMITED LIABILITY COMPANY (described as a 100% polyester fiber and low-pile-velour, pebbled, or shearling surface); FIBERTECT™ of INTEC Services, Inc (described as an inert, flexible, drapable, nonwoven composite substrate); and FUZUN™ of Vulcana, Inc (described as a nonwoven sheet rubber material that has a fabric face and a rubber back created by bonding Vulcana rubbRe™ material to a woven fabric as in 100% hemp burlap).

Figure 3:
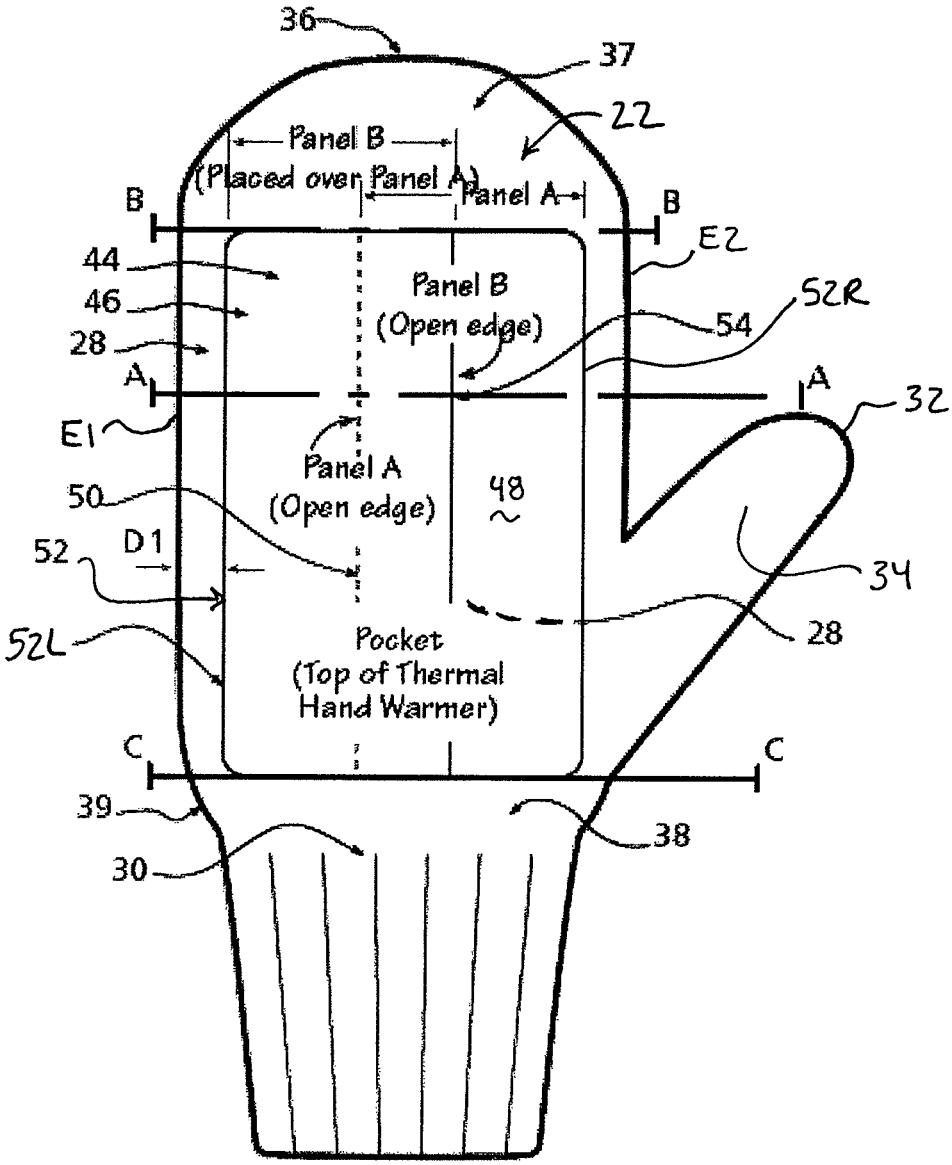
FIG. 3 shows a top plan view of the embodiment shown in FIG. 1 with integrated pocket.

Also, as shown in FIG. 3, main body 22 of hand covering 20 is (in the illustrated embodiment) a mitten that, in and of itself, has a continuous, top of hand extension portion 28 extending between the interior end 30 of wrist covering portion 26 and what would constitute the knuckle covering portion (which knuckles would be generally aligned with line A-A shown extending from the distal end 32 of thumb section 34 of main body 22). The line A-A extends across an intermediate portion of top of hand extension portion 28 with the top of hand extension portion 28 being shown as further extending to the opposite or distal end 36 of main body 22. Line A-A also is generally illustrative of the base region location for glove finger digits for the non-mitten embodiments of the invention.

In the mitten embodiment illustrated, top of hand extension portion 28 is shown as being generally rectangular in peripheral configuration up to line B-B with the remainder or finger end section 37 formed as a convex extension suited to accommodate the different lengths of the fingers of a hand.

In the embodiment described below some adult sizes are provided, although the invention features a variety of sizes inclusive of sizes for children (infants, toddler, young children, teen, etc.). As shown in the FIG. 2, the rectangular portion of main body 22 has a longitudinal extension of length L1 as in a length of about 5.75 inches (reference to lengths herein being illustrative, non-limiting length references, and also illustrative of a base-line for percentage reduction relative to the differences between standard adult sizes and standard respective children sizes). The lateral length of the rectangular portion of main body 22 is shown as the length extending between side edges E1 and E2, and perpendicular to the finger extension length. This length is about 4 inches in an embodiment such as that shown in FIG. 2. The aforementioned about 5.75 inches distance in the longitudinal direction (transverse to line A-A) and about 4.0 inches in the lateral direction (parallel to line A-A) provides a suitable foundation area for the perimeter 41 of pocket 24.

An illustrative perimeter 41 configuration is one that has a longitudinal length of P1 that is, for example, about 5.0 inches along the longitudinal and a width length W1 as in one that is about 3.25 inches along the lateral which provides a periphery well suited for receipt and relatively tight accommodation of a dispenser packet (e.g., plastic tissue or wet wipe pack casing or covering) as in one of an "off the shelf" size.

Figure 2:
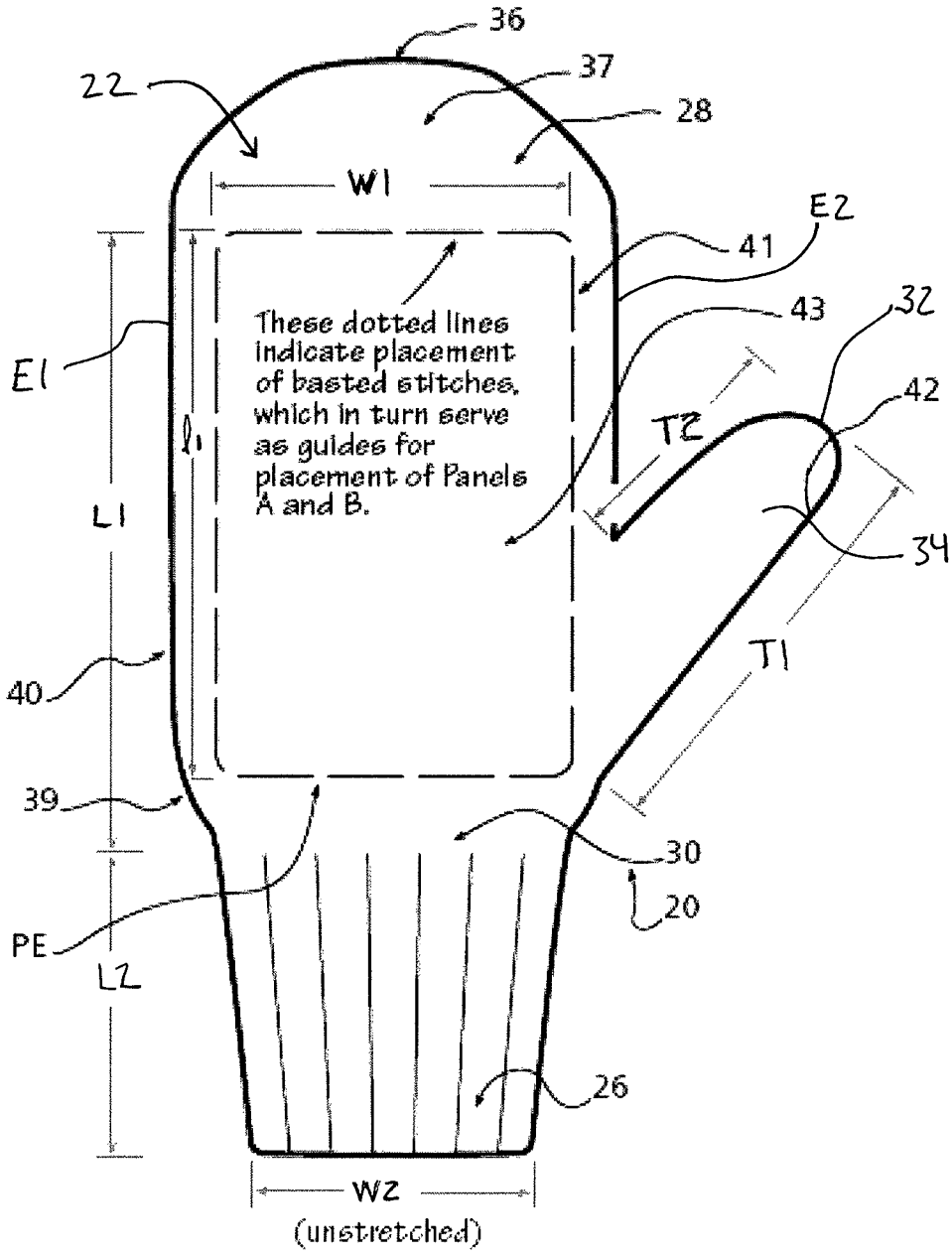
FIG. 2 shows a top plan view of the mitten in FIG. 1 without an integrated pocket or pocket covering but with guides provided for pocket alignment or placement.

With such a peripheral dimension the distal edge of the pocket 24 is placed between the middle finger distal end (as in the middle finger distal end for an adult hand inserted into hand covering 20) and the knuckle region or line A-A. Also, from the lateral perspective there is little lateral width space remaining not occupied by the pocket perimeter as in a spacing distance (D1 or D2) being less than 0.5 inch and more preferably less than or equal to about 0.25 inch clearance to opposite, respective sides of the longitudinal outer edges E1 and E2 of the hand extension portion 28. As shown in FIG. 2, the cuff end of covering 20 has the width W2 of about 2.5 inches (unstretched) and a longitudinal length of L2 of about 3 inches.

Variations are also contemplated under the current invention including providing a plastic lining in hand covering 20 (e.g., an internal above/below adhered plastic sheet set or a pre-formed plastic pocket liner or coating, or other water contact prevention means retained in pocket 24). In an alternate embodiment, sheet material such as tissues free of a tissue packet are stored in pocket 24 (a reception region that is free or inclusive of an aforementioned lining or water contact prevention means).

With reference to FIGS. 2 and 3 there is further seen that the proximal edge PE of the pocket periphery 41 is designed to extend along line C-C (FIG. 3) which is shown as extending generally through the border region 38 in main body 22 which is at the distal end of the curved expansion portion 39 extending out from the distal end of wrist portion 26 and at the proximal end of the less curved (e.g., generally straight) outer edge (non-finger side) 40 of main body 22. The location of C-C is also shown as being generally coincident with the base point of thumb 34. There is further shown length T1 as the longer side of the outer edge of the thumb section 32 with a length T1 of, for example, 3.75 inches being illustrative. The shorter opposite edge T2 of edge 42 of thumb section 32 is also shown as extending out from peripheral edge section E2 with a length of 2.25 inches being illustrative.

The dotted lines in FIG. 2 represents pocket periphery 41 in the illustrated embodiment and is preferably represented by suitable making means as in a stitch (e.g., a baste stitch) to help in the locating of a pocket to be integrated with main body 24. As shown, the pocket preferably has an interior base surface 43 defined by the portion of top of hand extension portion 28 of the main body that is confined within periphery 41 which is shown as preferably being a continuous extension of the material forming top of hand extension portion 28 (e.g., a common knit layer), although in an alternate embodiment a different material can be provided as base surface 43 formed within the confines of perimeter edge 41 representing border region 38. Examples of alternate material for base surface include a netting or alternate material layer including a plastic or waterproof sheet.

In an alternate embodiment, as wherein there is utilized a material for hand covering 20 that is sufficiently hand conforming (e.g., a stretch material throughout), there can be utilized the top of ones hand itself as a base support for a material or material packet to be inserted into the pocket 24 (e.g., an opening in the main body at the peripheral region of the pocket covering).

As seen from FIG. 3, pocket 24, in addition to the above-described base portion, has an outer pocket covering 44 (also referenced as 44L in view of the different configuration as compared to pocket 44R in FIG. 4) comprised of first cover or panel section 46 (panel "B") and second cover section or panel 48 (panel "A") shown as overlapping relative to the lateral direction (e.g., overlapping end regions which overlap area is generally centrally situated between edges E1 and E2 as well as the longitudinal end perimeter sections 52L and 52R). In an embodiment, each of panels 46 and 48 are of equal size as to be interchangeable but for their relative overlap relationship (e.g., relative overlap orientation and direction) as explained below.

For a left hand mitten as an example of hand covering 20 shown in FIG. 3, the right side or second cover section 48 is shown extending under the first or left side cover section 46 with the dashed line 50 representing the covered over end edge (longitudinally extending free edge) of cover section or panel 48. In the illustrated embodiment, the free edge 50 of right panel 48 extends for the full longitudinal length of border region 41. Also, the remaining edging 52 (longitudinal and lateral perimeter edge sections or portions designated generally by 52 in this embodiment) of right side panel 48 is preferably secured with securement means (e.g., a stitched attachment or integrated knitting arrangement, adhered or some alternate securement device or means such as a hook and loop VELCRO™ attachment or adhesive, or mechanical engagement). However, an integrated non-mechanical fastener arrangement between the pocket covering and main body as in one that is button free is preferred which holds true as well s the access opening for the pocket covering which seals without the need of an added fastener.

The overlap arrangement between the underlying free edge 50 for panel 48 and the overlapping free edge 54 for panel 46 thus further provides for the longitudinally extending, interior or free edge 54 of left or first panel 46 being an exposed end and representing the initial entrance (or final exit) edge relative to the access opening into pocket 24 for left hand mitten pocket 44L. The separation of the overlapping end regions with free edges is temporary in the illustrated embodiment and is designed to return to its previous sealed off state. Also, the panel 48 is flexible in this embodiment at least along a free edge region to flex when being transferred from an underlying relationship to an overlying relationship as illustrated in FIGS. 10A to 10D.

The length of overlap is designed in the illustrated embodiment to be suited for generally fully sealing off the material package contained in pocket 24 when in use but, upon separation, providing for ready access to the material to be dispensed as in-sheet like material (e.g., lifting up the overlapping panel on one hand with the opposite hand and with an embodiment including separation or lifting up of the overlying and overlapping portion preferably with an expansion facilitation provided by the material defining the uppermost panel 46 as in a knitted panel (such as one featuring common knit material as that provided for main body 22)).

The degree of overlap can be varied as in, for example, less than 15% (e.g., less than 30% of the full lateral width of the pocket) or replaced with a common edge-to-edge alignment or even, in alternate embodiments, a separation gap is featured as in one less than 30% of the full lateral width of the pocket 24. In the illustrated embedment, there is provided an overlap arrangement as in a 10 to 35% overlap relative to the full width of the pocket (or overall area of the pocket), with 15 to 25% being illustrative of additional percentage of overlap ranges featured under an embodiment of the present invention.

Figure 7:
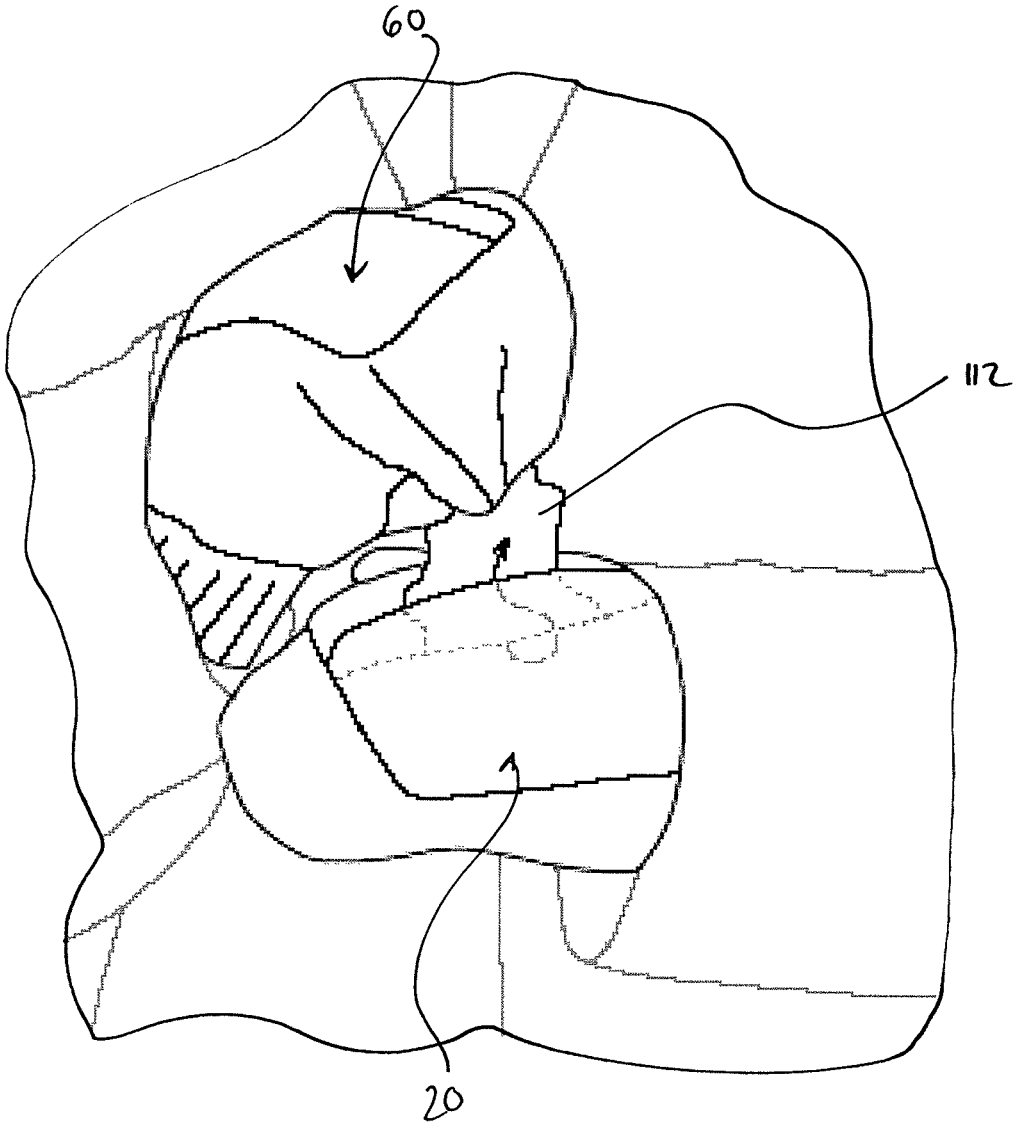
FIG. 7 shows the process of the right hand grasping the earlier grasped and released tissue shown in FIG. 6 to a more fully withdrawn state.
Figure 14:
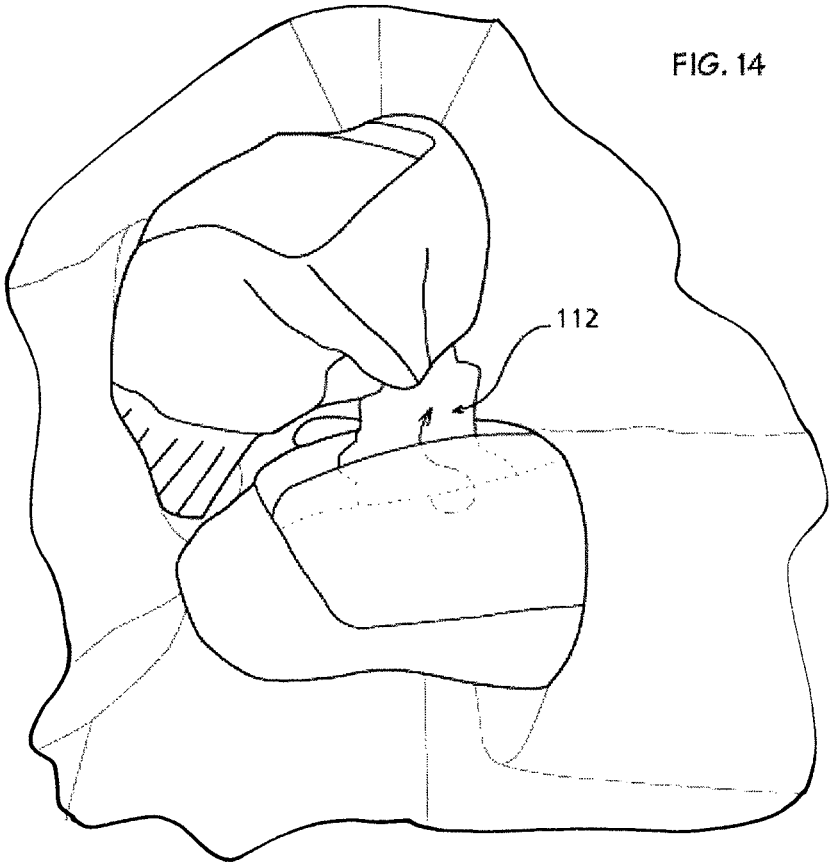
FIG. 14 shows a perspective view of the sheet like member being withdrawn with the opposite hand having a similar configured hand covering which has a pocket as in one suited for receptacle of a used sheet like member.
Figure 15:
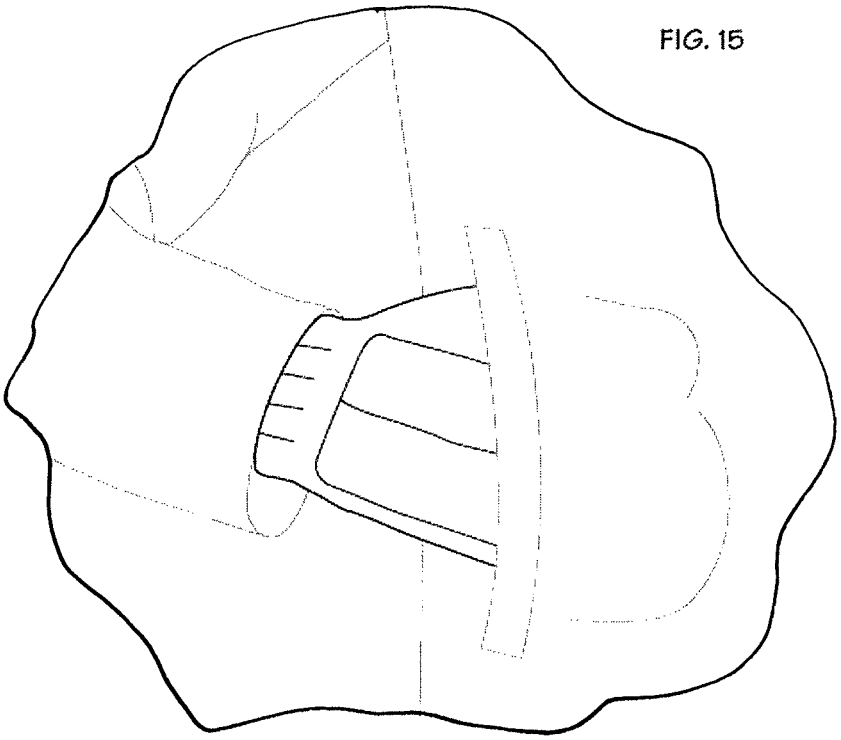
FIG. 15 shows a hand covering (with streamlined pocket and dispenser package included) being inserted into a coat pocket.

Also, the left hand panel 46 is preferably made as the outer panel relative to the overlapping arrangement as to facilitate an opposite hand manipulation as to remove access (or return) of material from (into) the pocket with an opposite hand. This can be seen from the opposite hand tugging on an exposed protrusion of a partially dispensed material sheet as shown in FIGS. 7 and 14. The opposite hand is also shown to be mitten covered in the illustrated embodiment and with a thumb which, like a glove embodiment, facilitates access and pinching of a sheet material (or reinsertion in a pocket), although non-thumb hand covering embodiments can also be utilized under the invention.

Having the aforementioned panel overlap as described above also provides for feeding a material packet or the material itself in a right to left direction in the FIG. 3 embodiment with a suitable passage below and to the right of the underlying free edge shown in dashed lines in FIG. 3 (which provides a locking arrangement or locking means relative to the package in the pocket). FIGS. 10A to 10D illustrate the initial insertion of a sheet material package into the pocket. This tight but flexible or expandable construction facilitates manipulation of the dispenser packet for insertion or removal with the same being true for dispensing and, possibly, returning sheet material into a pocket receptacle (e.g., the expansion can be facilitated through use of a stretchable material such as that provided by a knitted hand covering 20 such as, but not limited to, a hand knit material of yarn).

Figure 4:
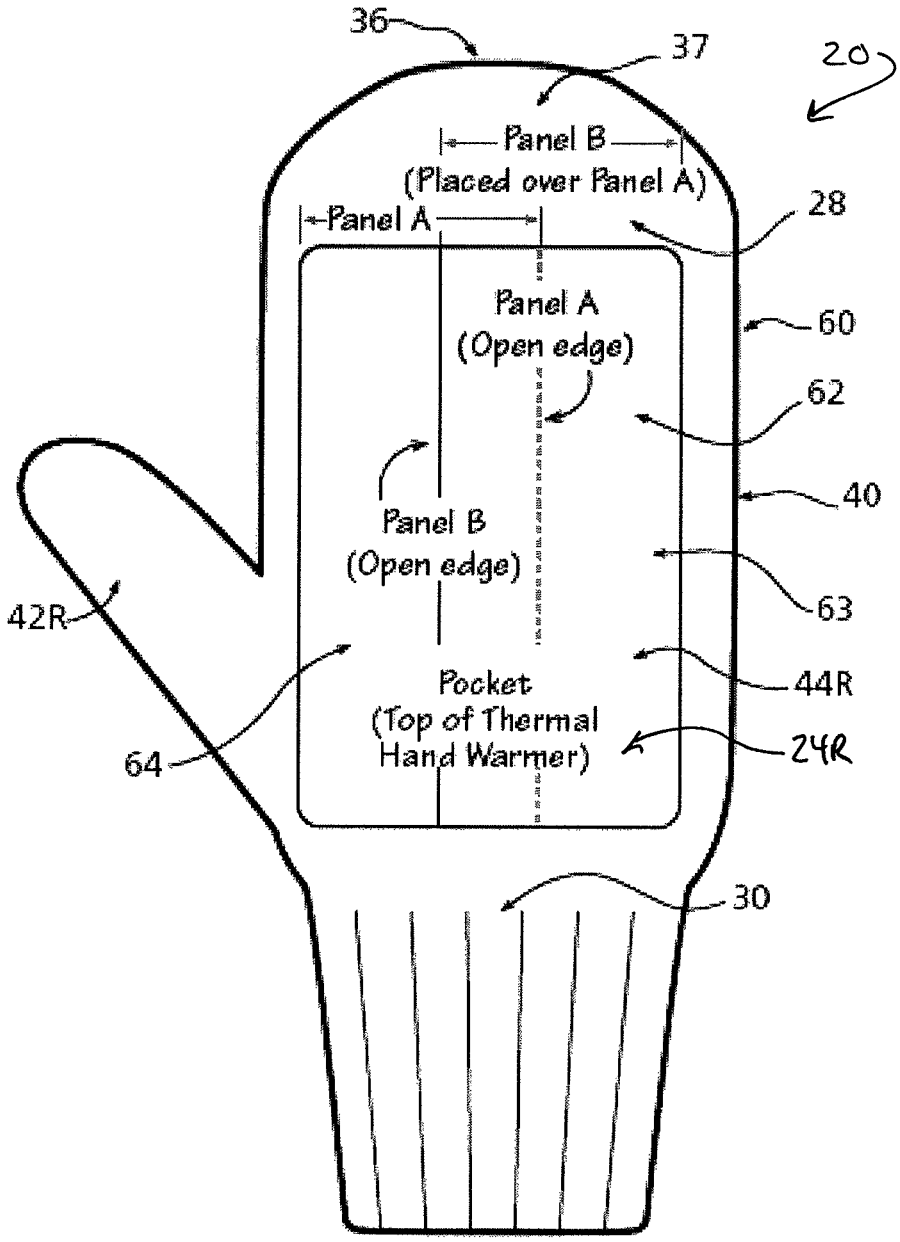
FIG. 4 shows a top plan view of an alternate hand covering configuration in the form of a right hand mitten with a modified pocket configuration compared to that of FIG. 3 well suited for use in the right hand mitten embodiment shown.

FIG. 4 shows a duplicate arrangement as that shown in FIG. 3 but for the hand covering 20 being an embodiment wherein the thumb extension (in this embodiment a thumb extension is present) is on the left which is the case for receipt of the thumb of a right hand for the right hand mitten 60 illustrated. An additional difference is that the outer or overlying panel 62 is represented by the right side panel 63 and the underlying panel 64 (relative to the overlap) is shown on the left side. Embodiments include a universal (left or right) main body for hand covering with there being only the difference in overlap orientation in the left and right windows which is possible when the formed hand warmer can be flipped over and present the same characteristic just for opposite hand usage. Other embodiments include the addition of added material pads as in palm coverings or under finger patch(es) provided on main body 22. In which case the left and right designations for the hand warmers would be predetermined relative to which pocket orientation is to be featured on the opposite side. This places the exit direction for a sheet of material as going from the top portion of the main body 22 toward thumb 42R for the right hand mitten 60 illustrated in FIG. 4 with a similar inward along a direction of lateral thumb extension being utilized when inserting a used sheet as in one initially obtained from the storage area provided by the left hand covering 20 shown in FIG. 3.

The entrance direction for a used tissue or a dispenser pack is thus in the opposite direction or from the thumb top 32 toward the opposite far edge (e.g., 40) for each hand covering.

A duplicate overlap distance in the right hand mitten pocket 44R as that of the left hand mitten pocket 44L is featured although different relationships for the free edges are also contemplated. Also, in FIG. 4, there is referenced with an "R" some of the common features in the left hand mitten such as pocket 44R.

An embodiment features the free edge in each of panel sections being provided with edge enhancement means (e.g., an end edge knit pattern or extra stitching or different material coating, or added fold, or added attachment contemplated) well suited for maintaining the edge over time despite repeated friction contact.

Figure 5:
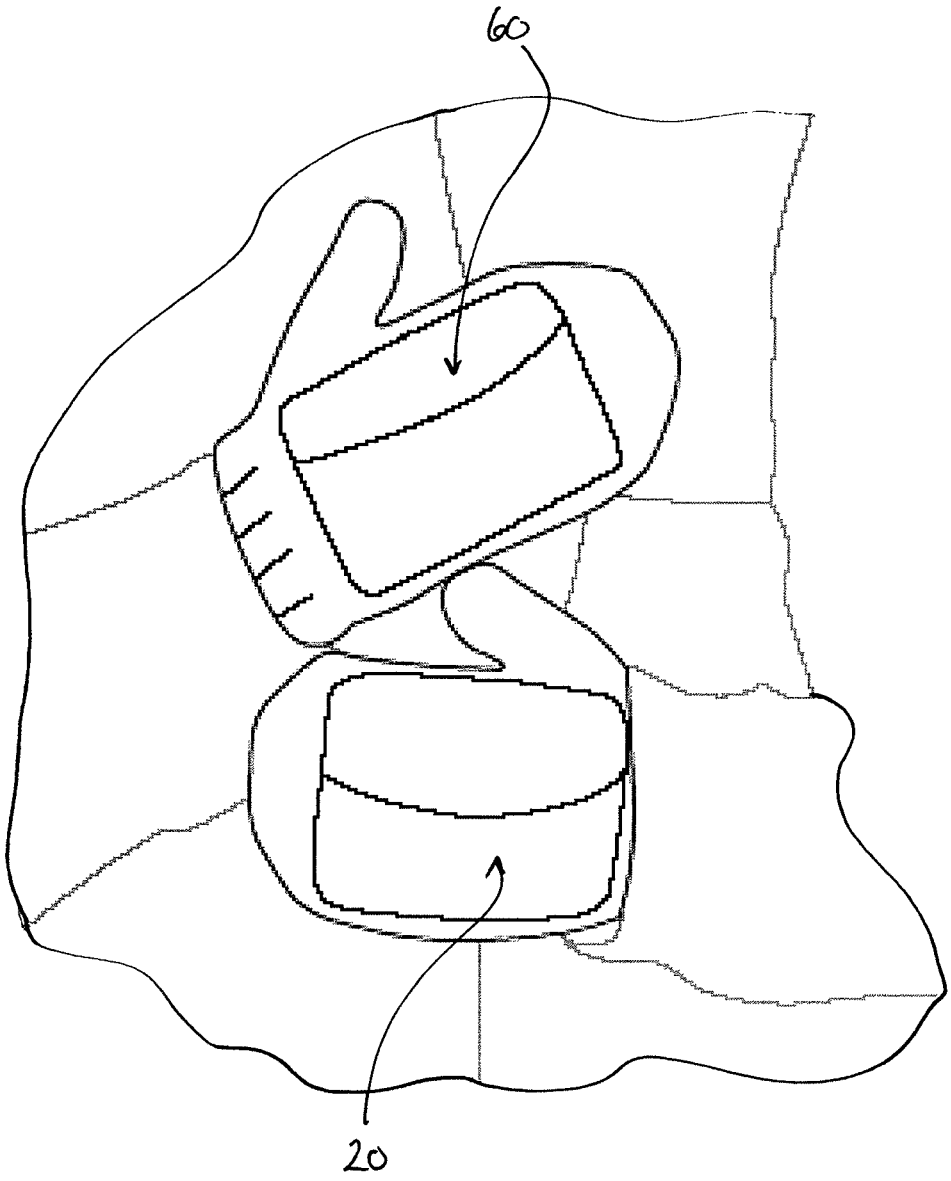
FIG. 5 shows a set of hand coverings corresponding with the hand coverings of FIGS. 3 and 4 (left and right mitten set) being worn with a tissue dispenser (as in a tissue dispenser package or tissue set) being fully enclosed (in the left hand mitten in this embodiment).
Figure 6:
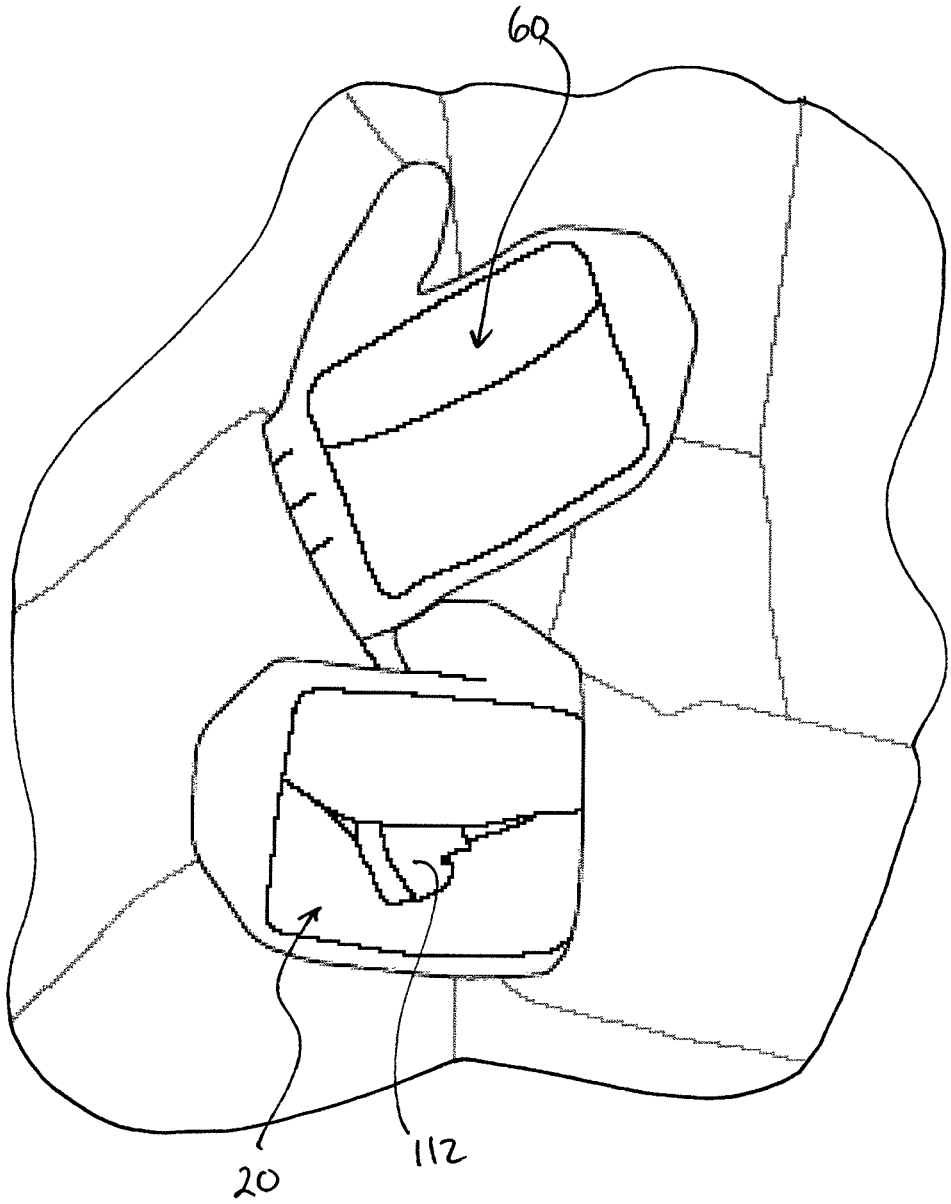
FIG. 6 shows a view similar to FIG. 5 with a tissue of the tissue dispenser package in a partially withdrawn state.

The different positioning of the panel sections provides for a coordinated pair of hand coverings with an example provided in FIGS. 5-7. Alternate embodiments, however, include just a single hand covering having the above-described features (e.g., a second mitten in a set being free of a pocket). However, as seen from FIGS. 5-7, there is a beneficial relationship in having a pair of hand coverings each comprising a respective pocket 24, with an embodiment with opposite outer panel relationships providing for reception and removal facilitation.

For example, in one embodiment, one of the pair of hand coverings can provide the reception pocket for the material to be dispensed as in a reception pocket for tissues such as a plastic pouch, packet or covering of tissue sheets while the other provides a disposal receptacle for used sheet material. Alternatively, at least one, if not both, of hand coverings 20 are provided with a suitable pocket 24 each having the same general functional capability. For example, in the FIG. 5 arrangement the left hand (or right hand) is originally provided with a material dispenser as in a tissue pack while the other is free of the same, but includes a pocket.

In one embodiment, like that depicted in FIGS. 5-7, the method of using the hand covering set includes removal of a tissue (with FIGS. 6 and 7 showing the steps of such manipulation by the opposite hand) with the opposite hand including an opposite hand still having a hand covering such as the mitten shown. Such a removal engagement with the opposite hand is seen in its near completion state in FIG. 7. Once the tissue shown in FIG. 7 is fully removed an embodiment of the invention includes the replacement of the last one with a similarly positioned next in line tissue or the like based as an overlapping or interlocked relationship in the tissues received in the dispensing pouch. The tissue end can then be either pulled out for access to an additional tissue, or left in its present state, or tucked slightly back into the overlapping region as when precipitation is falling.

Also, following usage of the tissue, as in the wiping of the nose, the used tissue can be inserted into the opposite hand covering pocket from the dispenser pocket. In an alternate embodiment a second or back-up tissue source (e.g., a second tissue dispenser package) is received within the opposite hand reception chamber (not shown).

While a variety of different materials are contemplated for use in the formation of hand covering(s) 20, 60 (e.g., a common or different material for the main body 22 and pocket 24) such as those described above, an embodiment features a fully knitted embodiment with a method of forming such a hand covering being provided below as an embodiment illustration that is not intended to be limiting.

As described below, the formation method is in the embodiment shown the same for the right and left mittens described above but for the direction of opening of the pocket access (and thus also the as worn direction of thumb location/extension).

Figure 8:
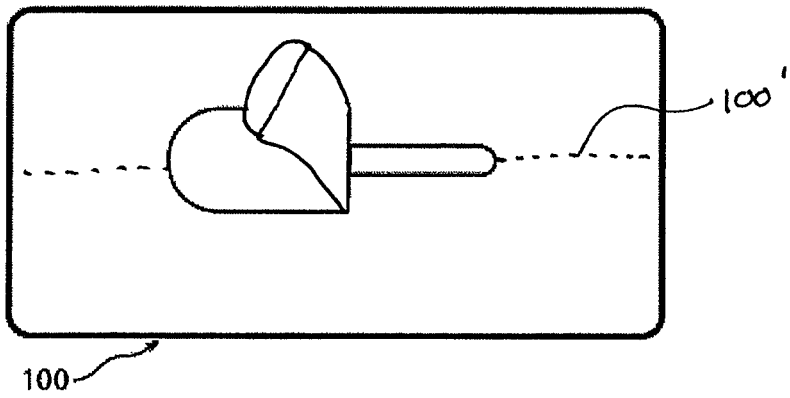
FIG. 8 shows a tissue or wipe dispenser packet with the adhesive sealant cover partially withdrawn with dashed lines showing a typical tissue pocket opening line and solid lines a more typical wipe exit opening.
Figure 9:
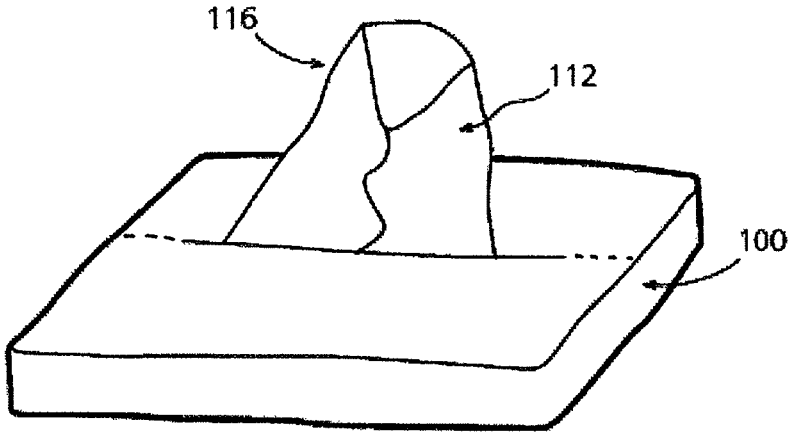
FIG. 9 shows a view similar to that of FIG. 8, but with the adhesive tab fully removed and one of the tissues (or wipes) having been pulled from the dispenser package.

With reference to FIGS. 8 and 9, there is seen dispenser packet 100 shown in FIG. 8 as being in an initial access state wherein a seal and adhesive cover flap is peeled back to gain access to tissues (or wipes) in the tissue (wipe) container. For example, an embodiment of the illustrated sealed dispenser pack is inclusive of sheets of material having additives as in alcohol based and optionally fluid absorbed wipes or tissues (e.g., tissues with added moisture or skin ointment material, etc.). Alternatively, the off the shelf plastic wrap for dry tissues (e.g., those with the rip open face facilitating tabbed ribbons are featured as a potential sheet material container or interior enclosure). In FIGS. 8 and 9 a dash line is illustrative of a dispenser with a line opening 100' for the sheet of material as opposed to one with an enlarged central access opening in the center as represented by opening 100.

FIG. 9 shows the same view as in FIG. 8 but with the adhesive cover tab removed and with the first sheet like member having been removed.

Figure 9A:
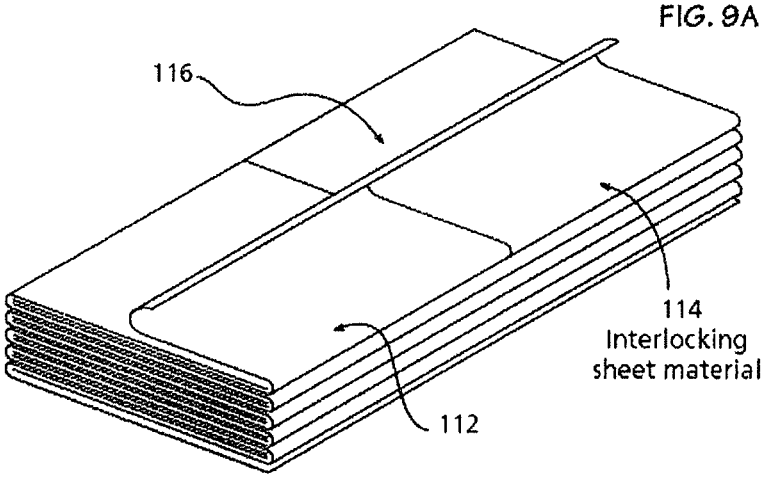
FIG. 9A shows an example of a interweaved stack of sheet material suited for insertion within a dispenser pack as in FIG. 9.

FIG. 9A shows an example of a sheet like material stack well suited for insertion into pocket 24 (either as is or in a dispenser packet such as in FIG. 9). For example, the dispenser pack 100 shown in FIG. 9 is preferably designed to house and store a plurality of sheet-like articles 122 in a water resistance environment. For a dry sheet-like article, such as a dry facial tissue, the dispenser 100 will retain the articles 122 in a dry state and prevent moisture or liquid from contacting them. For a wet sheet-like article, such as a wet wipe, the dispenser 100 will allow the articles 122 to retain their moisture until the user is ready to withdraw and use the wet wipe. The wet or dry sheet-like articles 122 can be removed from the dispenser 100 either individually or as a group of two or more.

An illustrative thickness dimension for the individual sheets is from about 0.4 millimeters (mm) to about 5 mm. Desirably, each sheet-like article 122 has a thickness that ranges from about 0.5 mm to about 3.5 mm. More desirably, each sheet-like article 112 has a thickness that ranges from about 0.6 mm to about 3 mm.

Dispenser pack 100 can contain a wide range of sheets but there is desired a streamlined arrangement in a preferred embodiment with 25 of less sheets as in 10 to 20 (e.g., 15) being illustrative. In FIG. 9A there is shown a plurality of Z-folded and interleaved sheet-like articles 112 depicted forming the stack 114 which can be housed in the dispenser package featured in FIG. 9.

Figure 13:
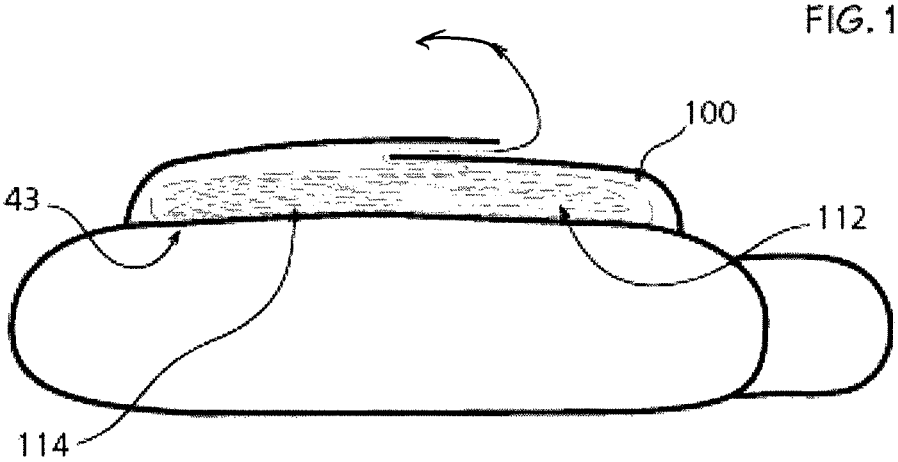
FIG. 13 shows a view similar to FIG. 12 with a sheet like member having been drawn out for usage (with the remaining sheet members preferably being in an interweaved stack as to have the next in line replace the removed one).

In FIG. 9A each of the sheet-like articles 112 in the stack 114 is shown interleaved or sandwiched between a portion of an adjacent sheet-like article 112 such that as the upper most article 112 is removed from the stack 114, the subsequent sheet-like article 112 will be exposed (e.g., just a small portion suitable for hand grasping as by way of an opposite hand with a mitten hand covering as in less than 25% of the area of the sheet material being dispensed). With this exposure, sheet 112 presents its upper edge 116 which is available to be grabbed or snatched. Further, as show in FIG. 7, for example, the sheet experiences some source resistance in going out of the package with the sheet having first been extended in a common direction to the exit direction from the package and then in an opposite direction in going from the free edge of the underlying panel and through the overlapping region of the panel. Once the sheet exits from the access opening of the pocket covering its direction is again reversed in the embodiment shown such that it is withdrawn in the same direction as was the direction the sheet initially left the sheet material source stack (e.g. see FIG. 13).

With reference to FIGS. 10A to 10D, there can be seen an initial sliding in of a closely fitting dispenser packet 100 into pocket 24. As seen, there is preferably little or no clearance relative to the respective longitudinal end edges between the dispenser packet 110 peripheral edge and the peripheral edge of pocket 24 (e.g., an expansion reception fit).

Figure 10A:
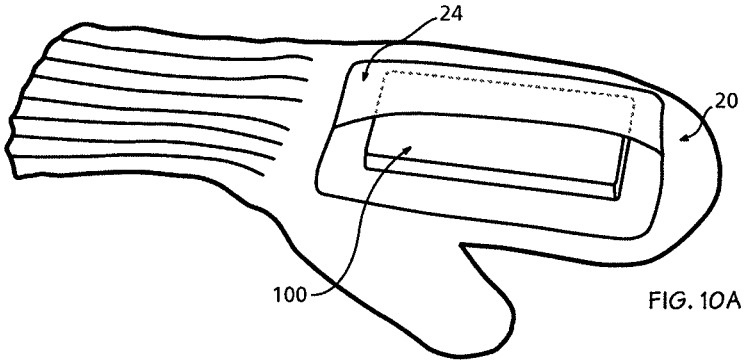
FIG. 10A to 10D show the sequence for insertion of a dispenser package into the hand covering of FIG. 3.
Figure 10B:
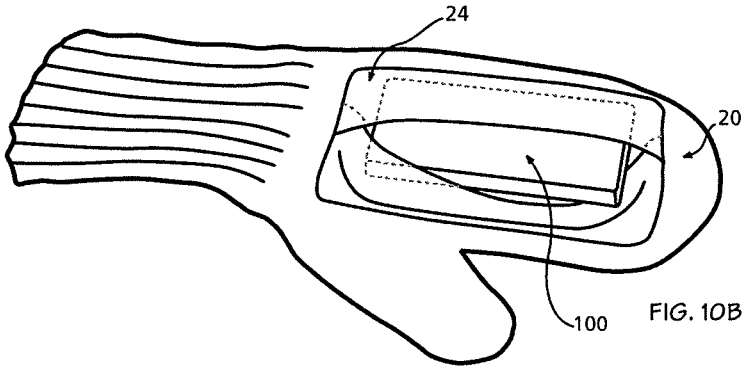
Figure 10C:
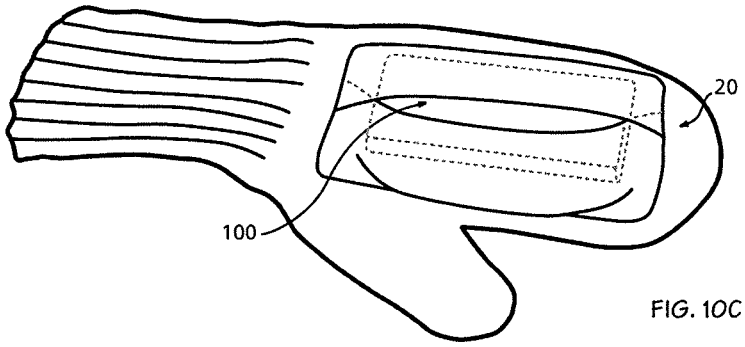

As seen in FIG. 10B, once partially inserted (e.g., the dispenser packet having one portion in its final location, but the pocket 24 yet to be fully positioned for full dispenser enclosure), the overlapping portion of the lower panel 48 is brought about from a below dispenser pack position to an above dispenser pack position. This then results in a full reception within the pocket once the overlap flap fully forms over the dispenser pack.

Figure 10D:
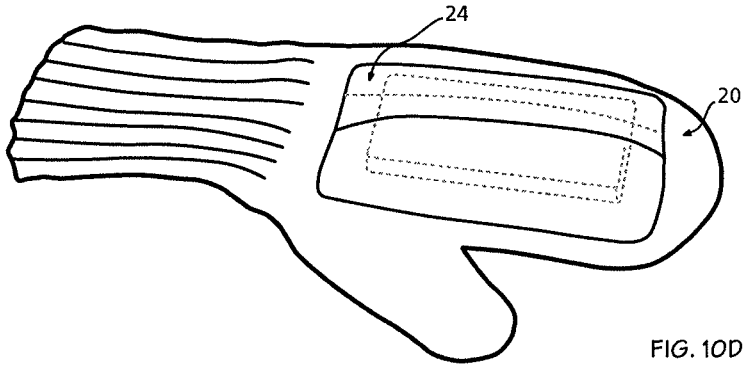
Figure 11:
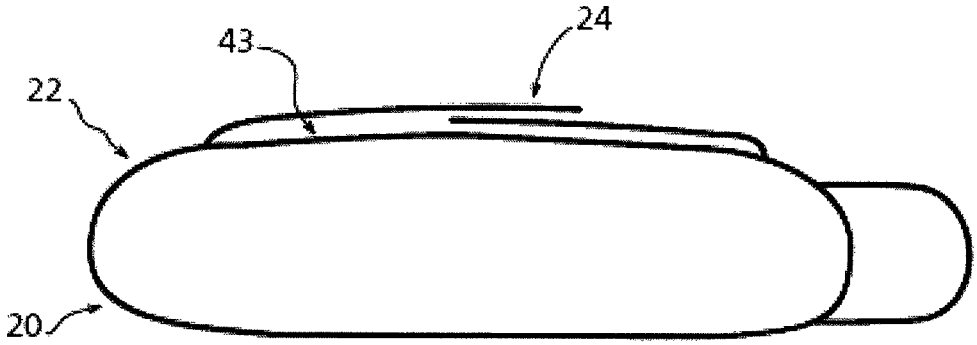
FIG. 11 shows a schematic view of the hand covering of FIG. 3 taken along cross-section line A-A with the pocket empty.
Figure 12:
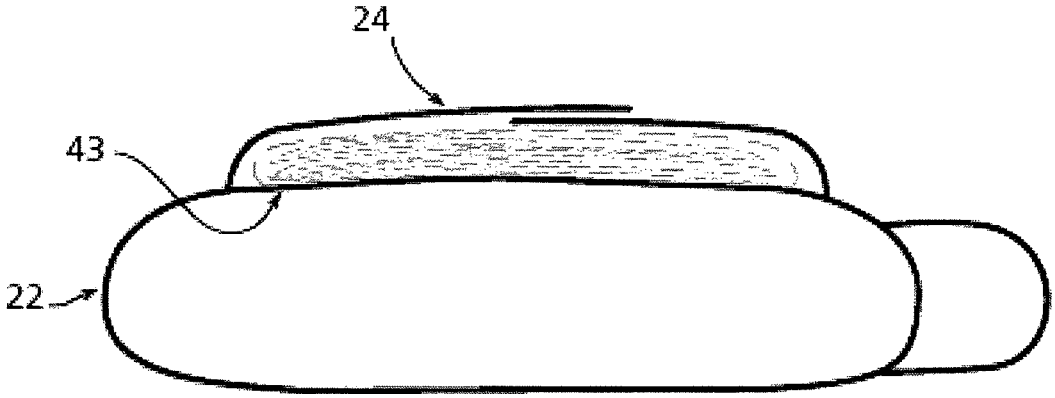
FIG. 12 shows the same view as FIG. 11 but with the dispenser package received.

During the process of insertion, the dispenser pack typically is crushed to some extent as to no longer be fully planar. The tight edge and above/below compression reception area defined by the preferably stretch/contraction material of the hand cover pocket 24 provides for a flattening out of the pack within the pocket as shown in FIG. 10D, although the sizing of the pocket in and of itself can do the same with flexible pocket covering material. Having the pocket panels of a flexible nature is typically suitable for initial insertion (with the overlying flap covering the dispenser but an edge of the dispenser extending over the free edge region of the underlying flap).

Provided below is a discussion of some manufacturing technique embodiments suited for the formation of hand covering 20 (60) which is in the form of a hand knitting manufacturing technique. Alternate, more automated techniques such as machine knitting and/or sewing techniques of suitable hand cover material(s) is also featured under the present invention.

Figure 16:
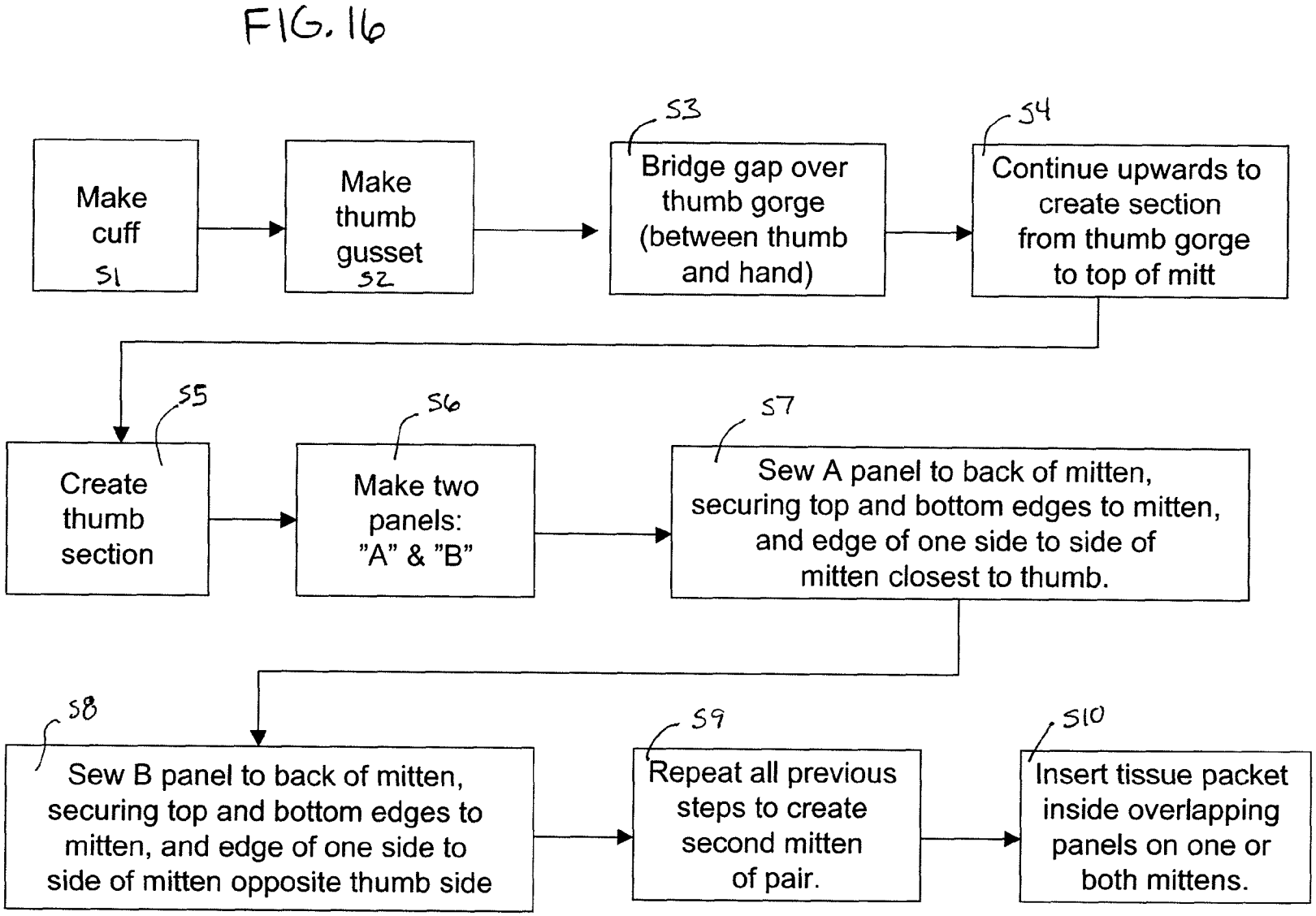
FIG. 16 shows a production or process flow chart for the production of a single hand covering (as well as a set of hand coverings with additional steps) and with a knitting technique involved.

FIG. 16 shows an example of steps suited for production of a hand covering like that shown in FIG. 1. This embodiment is inclusive of hand or automated knitting manufacturing technique. As an illustration of a suitable source material there is provided the following under the "materials" heading as well as some suitable hand knitting utensils.

Materials: 220 yards of light worsted (an illustrative usage amount is all of one 215-yd. skein as in Berroco Ultra Alpaca yarn so there is recommend a little extra yardage, just in case), five double pointed needles (DPNs) in size 3 US (or size needed to obtain gauge), 2 stitch markers, scrap yarn, seaming needle.

Gauge: 24 sts×32 rows=4"×4" in stockinette stitch.

Dimensions: 10" tall, 4" wide across knuckles, 4.75" from crook of thumb to fingertip.

Notes: Right and left mittens are the same in this embodiment (except for direction of opening on tissue pockets). Make two mittens with provided knitting technique.

Key to Abbreviations (In the Order they Appear in Providing Knitting Technique):

Cable Cast On=insert right needle between first two sts on left needle, wrap yarn around right needle and pull loop through (as if to knit). Pull loop toward you and place loop over the left needle, then tighten, creating one st.

CO=Cast on

K2P2=Knit two, purl two rib stitch

K2tog=Knit two sts together as one

M1L=Make One Left increase: With point of left needle, lift bar between st on right needle and st on left needle (lifting bar from front to back), then knit it through the back.

M1R=Make One Right increase: With point of left needle, lift bar between st on right needle and st on left needle (lifting bar from back to front), then knit it through the front.

PM=Place marker

SM=Slip marker

St st=Stockinette stitch

Rnd=Round (row)

RM=Remove marker

RS=Right side

SSK=Slip first st as if to knit. Slip second st as if to knit. Insert left needle through front of two slipped sts and knit these two sts as one.

WS=Wrong side

As shown in Step S1 of FIG. 16, there is formed a cuff as follows (e.g., the steps provided can be carried out in the sequence shown or in other sequence that is applicable relative to logical timing):

Cuff:

CO 48 sts onto four DPNs. (12 sts on each DPN)

PM to designate where rnd begins. Join work, being careful not to twist the sts.

Work 3" (24 rnds) in K2P2 pattern.

Work in St st for 6 rnds.

As shown in Step S2 of FIG. 16, there is formed a thumb gusset (e.g., again in the process shown in FIG. 16, the steps provided can be carried out in the sequence shown or in other sequence that is applicable relative to logical timing).

Thumb Gusset:

Rnd 1: SM, M1R, K1, M1L, PM, K to end of rnd. (50 sts).

Rnd 2: K

Rnd 3: K

Rnd 4: SM, M1R, K3, M1L, SM, K to end of rnd. (52 sts)

Rnd 5: K

Rnd 6: SM, M1R, K5, M1L, SM, K to end of rnd. (54 sts)

Rnd 7: K

Rnd 8: SM, M1R, K7, M1L, SM, K to end of rnd. (56 sts)

Rnd 9: K

Rnd 10: SM, M1R, K9, M1L, SM, K to end of rnd. (58 sts)

Rnd 11: K

Rnd 12: SM, M1R, K11, M1L, SM, K to end of rnd. (60 sts)

Rnd 13: K

Rnd 14: SM, M1R, K13, M1L, SM, K to end of rnd. (62 sts)

Rnd 15: RM, K15 sts, RM, put these last 15 sts onto scrap yarn, K to end of rnd. (15 sts on scrap yarn, 47 sts on DPNs: 11 on 1st DPN, 12 each on 2nd, 3rd, & 4th DPNs).

With reference to Steps S3 and S4 there is formed the hand portion as follows:

Hand:

Rnd 1: Turn work (WS facing). Using Cable Cast On, CO 5 sts. Turn work (RS facing). Transfer the last three CO sts onto the free DPN, PM, then K to 3 sts before end of rnd. PM.

K 3 sts.

Rnd 2: K1, SSK, SM. K to next marker, SM, K2tog, K1.

Rnd 3: SSK, RM. K to next marker, RM, K2tog.

There should be 48 sts (12 sts on each DPN).

K in St st until piece measures 5.75" from top of cuff.

As also shown in Step S4 there is formed the upper part of the mitten shown as follows:

Shape Top of Mitten:

Rnd 1: [K1, SSK, K18, K2tog, K1]. Repeat [ ]. (44 sts)

Rnd 2: K

Rnd 3: K

Rnd 4: [K1, SSK, K16, K2tog, K1]. Repeat [ ]. (40 sts)

Rnd 5: K

Rnd 6: [K1, SSK, K14, K2tog, K1]. Repeat [ ]. (36 sts)

Rnd 7: K

Rnd 8: [K1, SSK, K12, K2tog, K1]. Repeat [ ]. (32 sts)

Rnd 9: K

Rnd 10: [K1, SSK, K10, K2tog, K1]. Repeat [ ]. (28 sts)

Rnd 12: [K1, SSK, K8, K2tog, K1]. Repeat [ ]. (24 sts)

Rnd 14: [K1, SSK, K6, K2tog, K1]. Repeat [ ]. (20 sts)

Place 10 sts from first two DPNs onto one DPN. Place 10 sts from next two DPNs onto one DPN. Hold DPNs parallel (with yarn attached to back DPN) and seam sts using kitchener method.

As shown in Step S5 in FIG. 16, there is formed the thumb section as follows:

Base of Thumb:

Place 15 sts held on scrap yarn onto two DPNs. With third DPN, pick up 5 sts at the base of hand section in thumb gorge. (20 sts total)

Rnd 1: K one rnd.

Rnd 2: K until one st remains on second DPN. Slip that st onto third DPN. K2tog. K until one st remains on third DPN. Slip that st onto first DPN. K2tog. (18 sts remain)

K for 2.25" from where you picked up sts for thumb.

Shape Top of thumb:

Rnd 1: [K1, K2tog]. Repeat [ ] to end of rnd. (12 sts)

Rnd 2: [K2tog]. Repeat [ ] to end of rnd (6 sts)

Leaving a 6" tail, break yarn. Use seaming needle to pull yarn tail through remaining sts. Pull tightly and secure with knot at tip of thumb.

Turn mitten inside out and weave in all ends, closing up any holes at base of thumb. Trim remaining tails.

Steps S6 to S8 describe an embodiment of a method the formation of the pocket covering 24 (which is relative to a mitten and a tissue packet reception cavity in this embodiment) as follows:

Tissue Pockets:

Panel Formation Step S6 (First Panel):

CO 12 sts.

CO 12 sts.

Work in seed st pattern:

Row 1: [K1, P1]. Repeat [ ] to end of row.

Row 2: [P1, K1]. Repeat [ ] to end of row.

Repeat rows 1-2 until work measures 5".

BO loosely, leaving 10' tail.

Make three more panels of the same shape and size. Two will be "A" panels, and two will be "B" panels (relative to a set of mittens otherwise one panel A and one panel B for a single hand covering).

Steps S7 and S8 illustrate formation of a single pocket 24 while the discussion below is relative to preparing a pocket for each of two hand coverings in a set.

Lay mittens (such as those formed by the method steps S1 to S5) out flat with thumbs of mittens facing each other. Use seaming needle and contrasting color yarn to baste stitches in the shape of a rectangle as follows:

Back of mitten is 24 sts wide. Sides of rectangle should be 3 sts in from each side of mitten (i.e. between 3rd and 4th st, and between 21st and 22nd st).

Bottom of rectangle starts in row at which thumb gusset began (6 rows above cuff).

Top of rectangle ends where decreases began at top of mitten (5.75" above cuff).

Use these basted stitches to guide you as you sew the panels in place as follows:

"A" Panels should be sewn onto each mitten on side closest to thumb. Using yarn tails (when possible), sew only the top, bottom, and thumb-side of each panel to the mitten. Don't sew front and back sides of mitten together. Remove baste stitches as you go.

"B" Panels should be sewn so that they overlap "A" panels by 4 sts at center of mitten. Sew only the top, bottom and outer side of the panel to the mitten. The side that extends over Panel "A" should be open.

Secure and weave in all tails. Insert a packet of tissues as set forth in step S10 into one pocket. If there is too much bulk, take out some tissues from the packet. The other pocket can be utilized is for used tissues or the like.

Figure 17A:
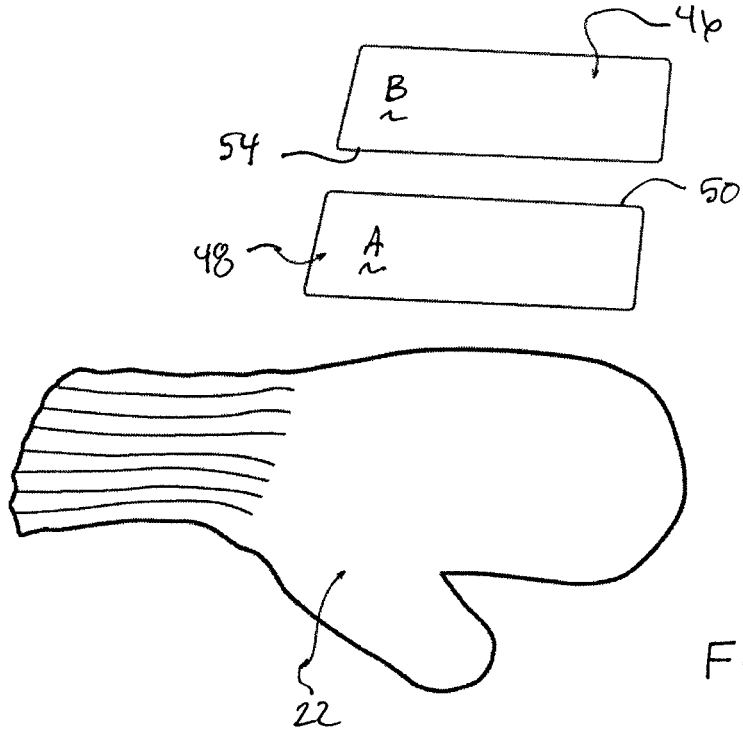
FIGS. 17A to 17D shows a sequence of steps suited for the providing of a pocket covering to a previously formed main body as to define a reception region in the hand covering.
Figure 17B:
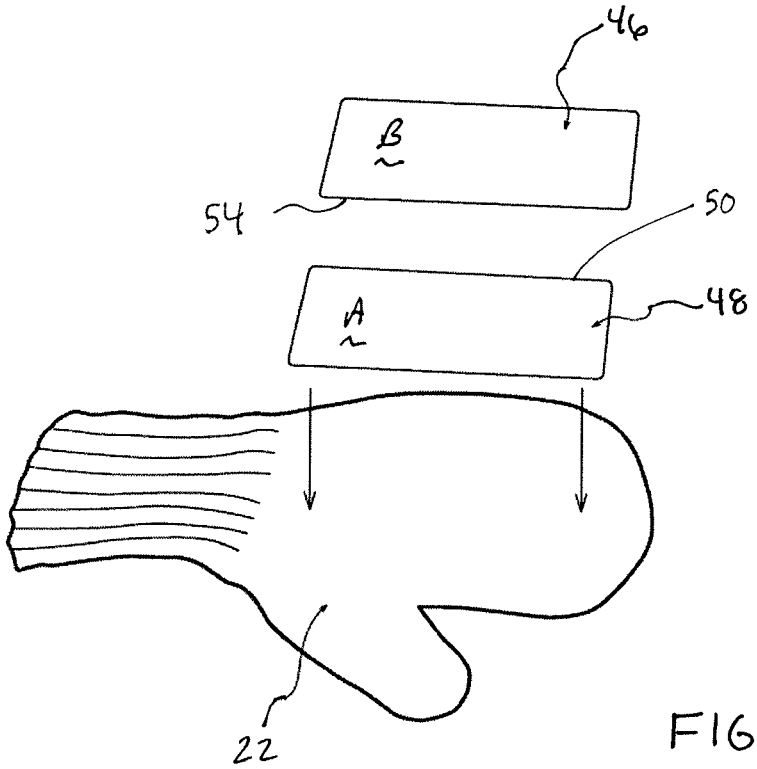
Figure 17C:
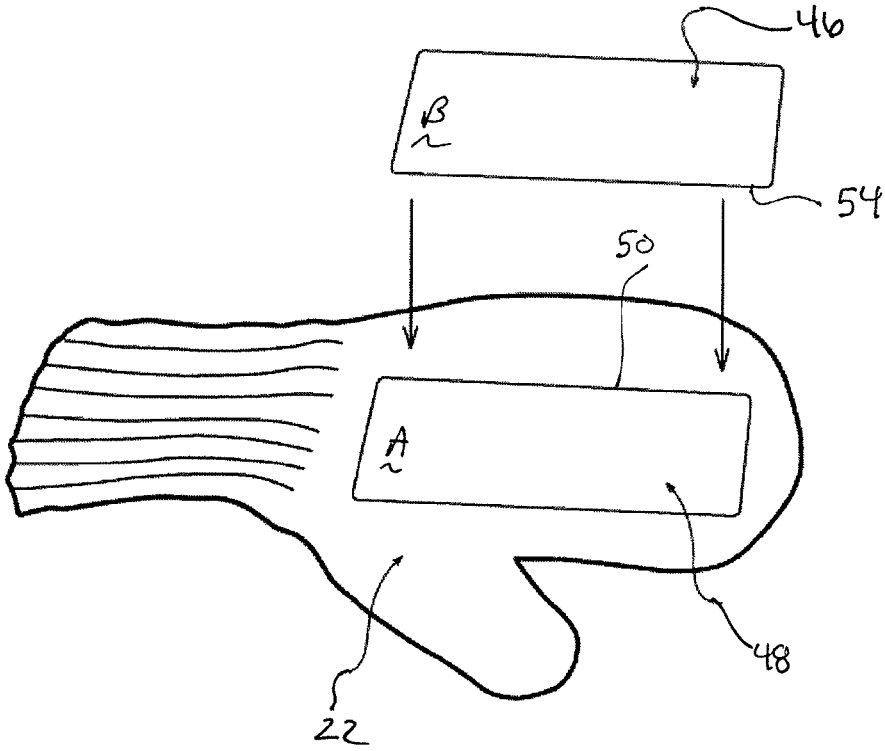
Figure 17D:
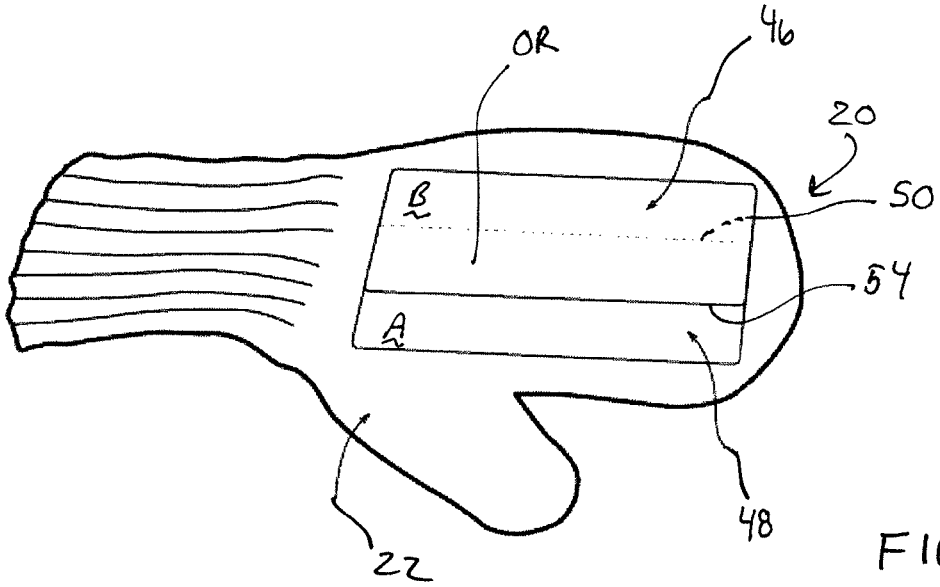

FIGS. 17A to 17D illustrate a method of forming pocket 24 relative to a mitten main body 22. As seen two same size and shaped panels ("A" and "B") are provided (FIG. 17A). In a first step panel A is brought and secured (FIG. 17B) to the knuckle covering region of main body 22 by securing (e.g., sewing) each of the three edges that do not constitute free edge 50.

In the method shown, panel B is then brought to and secured to main body with a portion of the longitudinal end edges overlapping but not fully extending as to define a centrally positioned overlap region or having a width represented by the lateral spacing of free edges 50 and 54. The non-free longitudinal edge is also secured to main body as by stitching as to provide the finalized hand covering 20.

Figure 18:
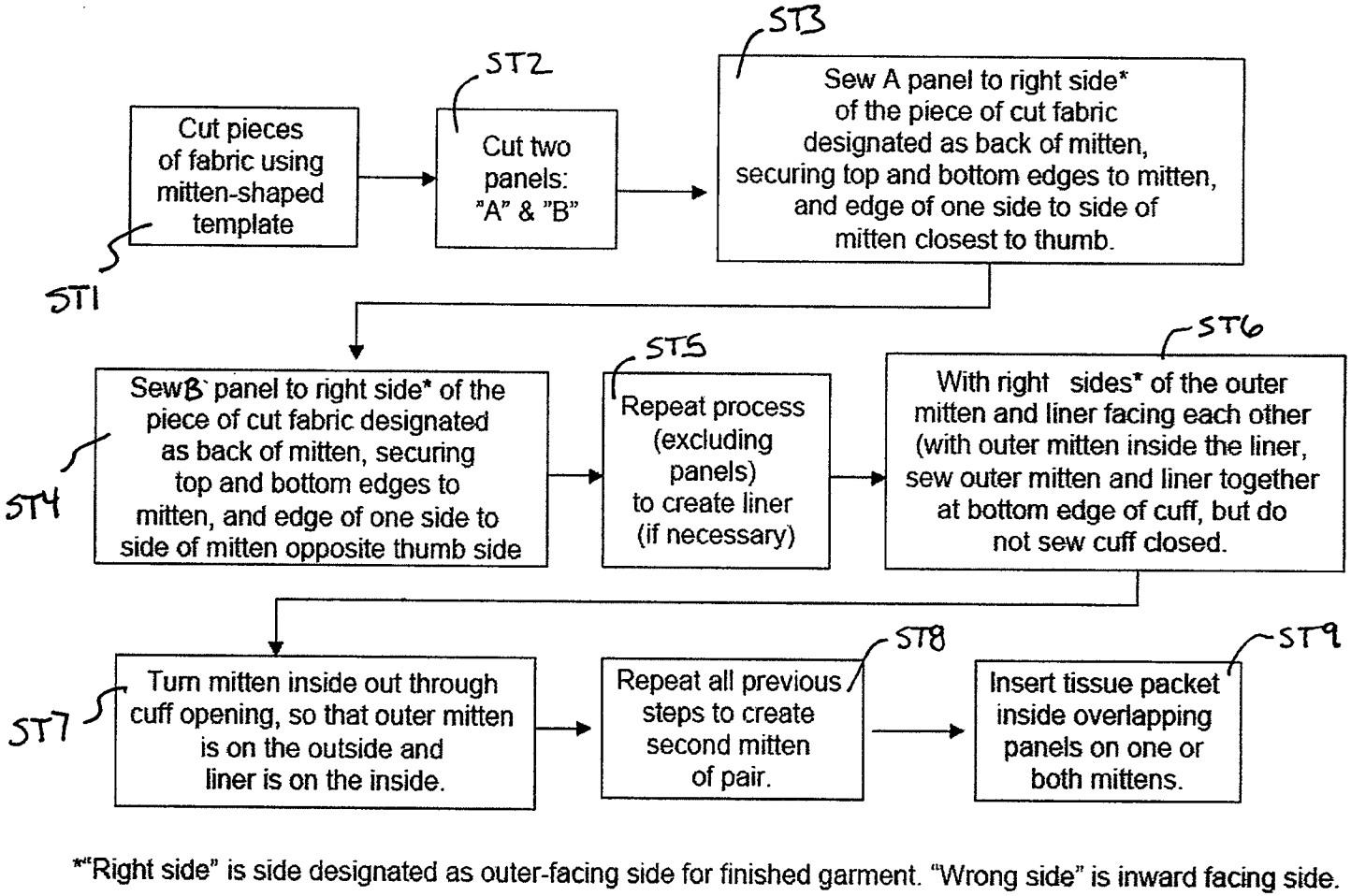
FIG. 18 shows a production or flow chart for the production of a hand covering (or set of same) with a sewing technique involved.

FIG. 18 shows a sequence of steps suited for forming a hand covering 20 through use of pre-formed fabric sheets which are cut to a mitten (in this embodiment) dimensions and then joined together as by sewing. There is further shown in FIG. 18 the steps for pocket formation and also the process for forming a set of hand coverings (20, 60).

That is, in a method of producing a hand covering 20 as in a mitten (or a set of hand coverings 20, 60) as with fabric as a source material and sewing steps, there is carried out the following:

Step ST1—cut pieces of fabric using mitten-shaped template;

Step ST2—cut two panels: "A" & "B" (as of the same size and shape);

Step ST3—sew A panel to right side* of the piece of cut fabric designated as back of mitten, securing top and bottom edges to mitten, and edge of one side to side of mitten closest to thumb;

Step ST4—sew A panel to right side* of the piece of cut fabric designated as back of mitten, securing top and bottom edges to mitten, and edge of one side to side of mitten opposite thumb side;

Step ST5—repeat process (excluding panels) to create liner (if necessary);

Step ST6—with right sides* of the outer mitten and liner facing each other (with outer mitten inside the liner, sew outer mitten and liner together at bottom edge of cuff, but do not sew cuff closed;

Step ST7—turn mitten inside out through cuff opening, so that outer mitten is on the outside and liner is on the inside;

Step ST8 (if set involved)—repeat all previous steps to create second mitten of pair; and Step ST9—insert tissue packet inside overlapping panels on one (or both—if set involved and is so desired) mittens.

Relative to the above asterisks "Right side" is the side designated as outer-facing side for finished garment. "Wrong side" is the inward facing side.

Figure 19:
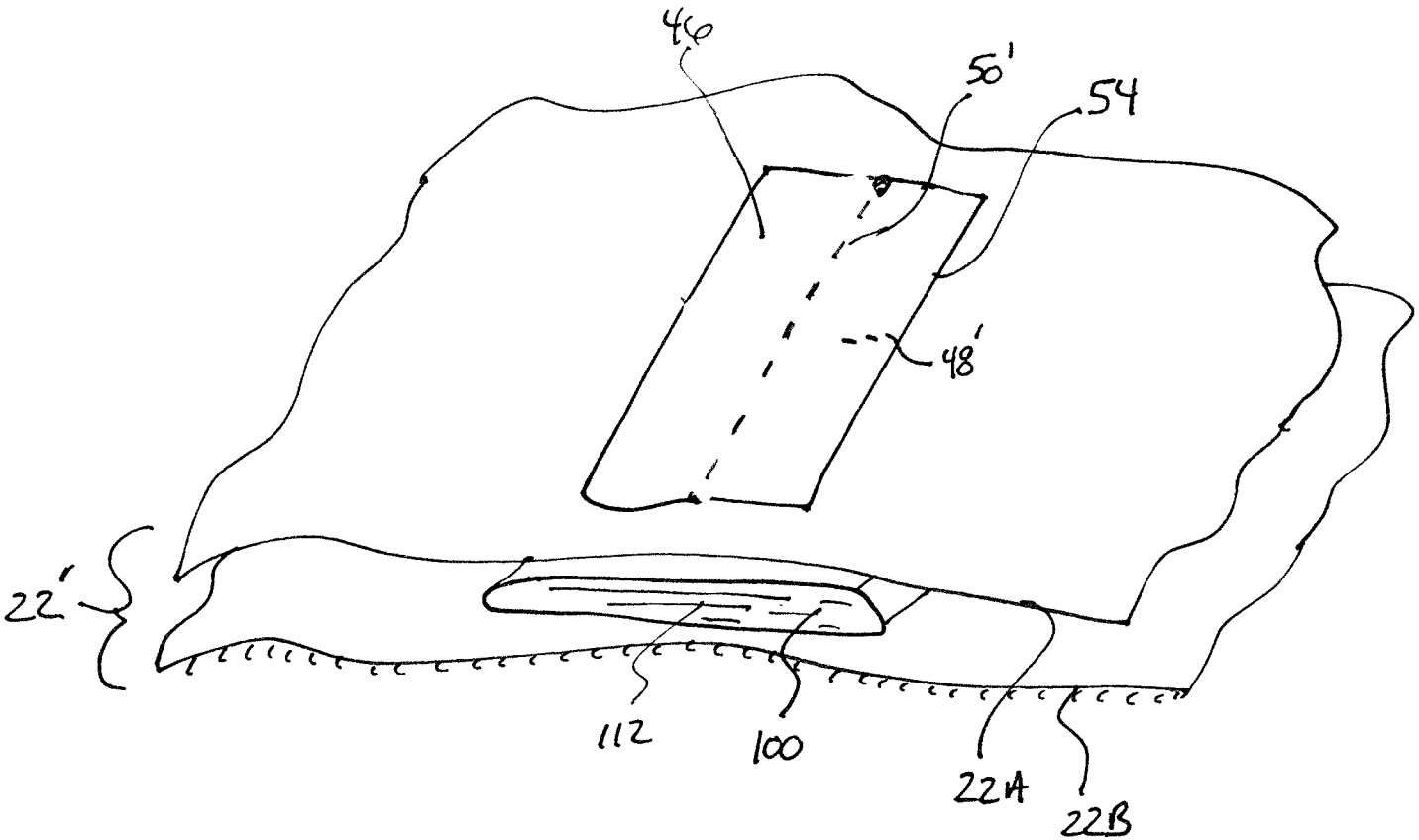
FIG. 19 shows an alternate embodiment with a hand covering body with two layers and an edge slit formed in the outer layer of the hand covering body (as to represent a panel with a free edge) and a second panel extending over the slit, edge opening in the outer body layer.

FIG. 19 shows an alternate embodiment wherein the body of the hand covering is defined by stacked layers 22A and 22B as would be present in a not completely laminated liner situation (e.g., connected at mutual edging liner situation). As further shown, there is a slit or slot 50' formed in the other layer 222A and that is covered over by panel 46 having a free edge 54 (the dotted line shown the underlying layer). Thus, in this embodiment a portion of the outer layer 22A of the body 22' is representative of a panel 48' covering over the cavity and forming part of an access opening suited for accessing the cavity formed between layers 22A and 22B within which is shown a received packet 110 with sheet material 112.

The present invention also comprises a kit to facilitate the formation of a hand warmer 20 which is preferably universal relative to being suited to provide either of both of a left hand covering with pocket and a right hand cover with pocket such as that described above. This kit comprises, for example, one or more (or all or any sub-combination) of the following elements "a" to "d".

a) formation pattern plan (e.g., a knitting pattern as in a software storage disc or hard copy pattern which contains a description such as that provided above as to how to form a hand covering under the present invention);

b) implements for assembling (e.g., a knitting needle set);

c) material for forming (e.g., a yarn and thread supply); and d) a dispenser packet with sheet material (e.g., a tissue pack).

What is claimed is:

1. A hand covering, comprising;

a main body having a reception cavity dimensioned for receipt of a hand of a user;

a pocket covering that defines a reception region and is secured to said main body along a peripheral edge perimeter region of said pocket covering, said pocket covering having a first panel with a free edge and a second panel with a free edge; and said free edges being oriented as to provide an access opening that extends inward relative to the peripheral edge perimeter region and which access opening defines a sheet material insertion or removal location relative to the reception region, and said pocket covering is free of a fastener inward of opposite securement locations of said free edges of the pocket covering at the peripheral edge perimeter region, wherein said panels are in an overlapping relationship such that the free edge of the first panel is exposed and the free edge of the second panel is covered over by the first panel, and wherein the free edge of the first panel is positioned in an intermediate region of the pocket covering that falls in-between opposite pocket perimeter edge sections of said peripheral edge perimeter region.

2. The hand covering of claim 1 wherein the opposite pocket perimeter edge sections and said free edges all extend essentially parallel.

3. The hand covering of claim 1 wherein the overlap between the first and second panels is 30% or less than an overall exposed area of the pocket covering.

4. The hand covering of claim 3 wherein the overlap is 10 to 25%.

5. The hand covering of claim 1 wherein the hand covering comprises a thumb extension and wherein the first panel includes an inner edge defining the free edge of the first panel and a perimeter edge section positioned opposite to said inner edge, and the perimeter edge section of the first panel is secured to said main body, and said second panel includes an inward edge defining the free edge of the second panel and a peripheral edge section positioned opposite to the inward edge and secured to said main body, and wherein said panels are in an overlapping relationship such that the free edge of the first panel is exposed and the free edge of the second panel is covered over by the first panel, and wherein the free edge of the first panel is positioned closer to the thumb extension than the perimeter edge section of said first panel.

6. The hand covering of claim 1 wherein said hand covering is 100% knitted material with the covering portion integrated by a knitting pattern relationship with said main body.

7. The hand covering of claim 1 wherein each panel has a common shape and is of an essentially same size such that said first panel is non-detachably secured to said main body by way of an intermediate securement with an underlying portion of said second panel.

8. The hand covering of claim 1 wherein said main body includes an extension portion that extends under the pocket covering as to further define the reception region, and wherein said pocket covering is secured on an upper surface of said main body so as to be positioned for covering over an upper surface of the hand of the user received in the hand covering.

9. The hand covering of claim 8 wherein the reception region is dimensioned for receipt of a sheet material dispenser package in a tight fit relationship both relative to a direction perpendicular to a plane lying flush on the extension portion of said main body and peripherally, and wherein the reception region is dimensioned such that a received dispenser package is generally centered relative to the overlapping end regions of said first and second panels.

10. The hand covering of claim 9 wherein the reception region is dimensioned for receipt of a sheet material dispenser package having 25 sheets or less with the sheets being in an interweaved relationship and being 0.5 mm to 3.0 mm in thickness.

11. The hand covering of claim 10 wherein the reception region is dimensioned for receipt of a tissue dispenser package, and said hand covering further comprising a dispenser package received and covered by said pocket covering and with the overlapping regions of said panels providing a tissue dispense opening in said hand covering which presents a reverse direction pattern in a tissue passing through the access opening of said pocket covering.

12. The hand covering of claim 1 wherein said pocket covering has an elongated configuration that has a longer extension in a direction of finger extension than lateral to that direction, and wherein said pocket covering extends to opposite sides of a knuckle covering region of said hand covering.

13. A hand covering kit, comprising;

a first hand covering and a second hand covering with each of said hand coverings having a) a main body having a reception cavity dimensioned for receipt of a hand of a user; and b) a pocket covering which is secured to said main body and defines a reception region, said pocket covering having a first panel with a free edge and a second panel with a free edge, with the free edges being oriented as to provide, when in use, a sheet material insertion or removal opening for accessing the reception region, and wherein said panels are in an overlapping relationship such that the free edge of the first panel is exposed and the free edge of the second panel is covered over by the first panel, and wherein the overlapping arrangement of the free edges is arranged such that sheet material access or removal is carried out by tensioning of the exposed free edge of the first panel as to convert the free edge of the first panel from a state of contact with the second panel to a state of at least partial separation from a previously contacted and overlapped region of said second panel, and wherein, within the overlapping arrangement, the first panel is non-detachably secured to said main body at opposing ends of the first panel within the overlapping region of the first and second panels.

14. The hand covering kit of claim 13 wherein, when a user extends each arm supporting the first and second hand coverings directly out with knuckles up top, the non-covered portions of said second panels of the first and second hand coverings are more closely positioned to each other than the covered portions of said second panels.

15. A hand covering, comprising;

a main body having an opening for receipt of a hand of the user;

a pocket covering that defines a reception region and which comprises a first panel with a peripheral edge region secured to said main body and a second panel with a peripheral edge region secured to said main body, and said first panel having a free edge region with a free edge and said second panel having a free edge region with a free edge, and the free edge region of said first panel extending over the free edge region of the second panel in an overlapping relationship as to have the free edge of the first panel define an access opening relative to the reception region and which access opening is in an intermediate region of the pocket covering, and wherein said free edge region of the first panel is formed of a flexible, stretchable material and secured at opposite ends, and wherein said free edge region of the first panel is self-sealing such that, after opening, said free edge region of the first panel self-returns starting from a maximum open state to a sealed state by way of a return from a stretched material state.

16. The hand covering of claim 15 wherein said pocket covering is designed such that access to the reception region is achieved by way of stretching of the first panel relative to the second panel and free of any pivoting of either of said panels relative to said main body.

17. The hand covering of claim 15 wherein said pocket covering is arranged as to require a sheet of material in a dispenser received in the reception region to first travel in a first direction perpendicular to the free edge of the first panel and then travel in a second direction opposite to the first direction during exiting of the sheet of material from the pocket covering.

18. A method of assembling the hand covering of claim 1 comprising:

providing the main body having a reception cavity dimensioned for receipt of a hand of a user;

providing the pocket covering which defines a reception region, said pocket covering having a first panel with a free edge and a second panel with a free edge at least partially covered over by said first panel, and wherein said free edges are oriented as to provide, when in use, a sheet material insertion or removal opening relative to the reception region, and wherein the reception region extends to opposite sides of the free edge of the second panel in a common direction with tissue insertion or removal, and for an amount that is equal to or more than a length of overlap in said common direction.

19. The hand covering of claim 1 wherein secured ends of the free edges are non-detachably secured to said main body.

20. The hand covering of claim 15 wherein the secured opposite ends of the first panel are permanently secured to the main body.

21. The hand covering of claim 15 wherein said pocket covering is free of a fastener inward of opposite securement locations of said free edges of the pocket covering at the peripheral edge perimeter region.

22. The hand covering of claim 15 wherein the first panel comprises a non-free edge portion which represents that which is secured to said main body, and wherein the entire non-free edge portion of the first panel is non-pivotably secured to said main body.

* * * * *